US010590525B2

(12) United States Patent
Plana et al.

(10) Patent No.: US 10,590,525 B2
(45) Date of Patent: Mar. 17, 2020

(54) MODIFIED SURFACE PROPERTIES OF PERCUSSION TOOLS USED IN DOWNHOLE DRILLING

(71) Applicant: VAREL INTERNATIONAL IND., L.P., Carrollton, TX (US)

(72) Inventors: Anthony Stuart Plana, Prosper, TX (US); Ted James Breckenfeld, Carrollton, TX (US); David M. Harrington, Dallas, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 84 days.

(21) Appl. No.: 15/923,217

(22) Filed: Mar. 16, 2018

(65) Prior Publication Data

US 2018/0202033 A1 Jul. 19, 2018

Related U.S. Application Data

(63) Continuation of application No. 14/870,847, filed on Sep. 30, 2015, now Pat. No. 9,951,409.

(51) Int. Cl.

| | |
|---|---|
| ***E21B 6/00*** | (2006.01) |
| ***C23C 8/56*** | (2006.01) |
| ***E21B 1/00*** | (2006.01) |
| ***C23C 8/80*** | (2006.01) |
| ***C25D 7/00*** | (2006.01) |
| ***C21D 9/00*** | (2006.01) |
| ***C23C 28/00*** | (2006.01) |
| ***E21B 4/14*** | (2006.01) |
| ***C23C 28/04*** | (2006.01) |

(52) U.S. Cl.

CPC ..... *C23C 8/56* (2013.01); *C21D 9/0068* (2013.01); *C23C 8/80* (2013.01); *C23C 28/00* (2013.01); *C23C 28/042* (2013.01); *C23C 28/044* (2013.01); *C23C 28/046* (2013.01); *C23C 28/321* (2013.01); *C23C 28/34* (2013.01); *C25D 7/00* (2013.01); *E21B 1/00* (2013.01); *E21B 4/14* (2013.01); *E21B 6/00* (2013.01)

(58) Field of Classification Search

CPC ..... E21B 1/00; E21B 4/06; E21B 4/14; E21B 6/00

USPC ..... 175/296

See application file for complete search history.

(56) References Cited

U.S. PATENT DOCUMENTS

| | | | | |
|---|---|---|---|---|
| 3,446,294 A * | 5/1969 | Bailey | B25D 17/00 173/138 |
| 2012/0186878 A1* | 7/2012 | Eddison | E21B 4/14 175/57 |
| 2015/0060139 A1* | 3/2015 | Brice | E21B 4/14 175/19 |

* cited by examiner

*Primary Examiner* — Taras P Bemko

(74) *Attorney, Agent, or Firm* — Corinne R. Gorski

(57) ABSTRACT

A system and method of fabricating a percussion tool that includes one or more surfaces modified using the ferritic nitrocarburization process. The percussion tool includes a piston positioned in sliding contact within a casing. The piston includes an inner wall and an outer wall, where the inner wall defines a passageway extending longitudinally therethrough. The outer wall is positioned in close fitting relationship with an internal surface of the casing. One or more surfaces of at least one of the casing's internal surface and/or the piston's outer wall are modified using the ferritic nitrocarburization process.

11 Claims, 11 Drawing Sheets

MODIFIED SURFACE PROPERTIES OF PERCUSSION TOOLS USED IN DOWNHOLE DRILLING

BACKGROUND

This invention relates generally to modifying the surface properties of percussion tools used in downhole drilling. More particularly, this invention relates to an apparatus, system, and method for reducing friction and/or dispersing heat generated by the sliding motion of a piston within percussion tools, such as rotary bits, shear bits, and hammer bits, used in downhole drilling.

In the drilling industry, percussive hammers have long been used to aid in rock drilling. Historically, a solid piece drill bit and a "down the hole" ("DTH") hammer have been used as a rock drilling solution. The DTH hammer is a pneumatic tool which is driven by high pressure air. The air drives a piston in a reciprocating motion and when in a downward motion, the piston makes impact onto a mandrel. The piston impacting the mandrel transmits a force into the rock, causing fracture to the rock.

Recently, a rotary and percussion hybrid system ("RPS") has been investigated for use in the industry. This RPS system also uses a reciprocating piston that is slidably positioned within a casing. This piston is driven by pressurized air. In this system, a roller cone bit, or some other bit type, replaces the solid piece drill bit and the drill mechanically transmits significant downward force and rotation to fracture the rock with a combination of direct load and percussive impact. Like in the DTH hammer, the percussive impact is caused by the piston impacting a mandrel, which transmits a force into the rock.

The piston within the RPS tool, as well as in the DTH hammer tool, slides inside a casing, in a reciprocating manner. Typically, the casing and the piston are both manufactured using steel. During this reciprocating motion, the piston is in contact with at least a portion of the casing and generates friction therebetween. This friction generates heat. Due to the high sliding velocities achieved by the piston, which is about four to five meters per second (m/s) or about sixteen cycles per second, an oil-filled apparatus, otherwise known as an oiler sub (not shown), is typically used to inject oil into the high pressure air stream, which thereby lubricates the piston during operation and reduces the heat generated if compared to when an oiler sub is not used.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein:

FIG. 1A is intended to be joined to FIG. 1B along common line a-a in accordance with an exemplary embodiment of the present invention;

FIGS. 4A-4J-2 are cross-sectional views of the percussion tool of FIG. 3 without the bit illustrating the operation of the percussion tool in accordance with an exemplary embodiment of the present invention.

The drawings illustrate only exemplary embodiments of the invention and are therefore not to be considered limiting of its scope, as the invention may admit to other equally effective embodiments.

DETAILED DESCRIPTION OF THE INVENTION

This invention relates generally to modifying the surface properties of percussion tools used in downhole drilling. More particularly, this invention relates to an apparatus and method for reducing friction and/or dispersing heat generated by the sliding motion of a piston within percussion tools, such as rotary bits, shear bits, and hammer bits, used in downhole drilling. More specifically, surfaces modified according to the invention provide one or more of the following characteristics when compared to unmodified surfaces: a) higher abrasion resistance, b) higher lubricity (i.e. lower coefficient of friction), c) improved chemical stability, and d) high hardness. These beneficial characteristics decrease and even eliminate the need for oil as a means for decreasing friction between moving surfaces.

Although the description provided below is related to a percussion tool with a rotary bit, exemplary embodiments of the invention relate to any downhole percussion tool including, but not limited to, percussion tools having a shear bit, a hammer bit, or other known bits used in percussion tools.

Figure 1A:
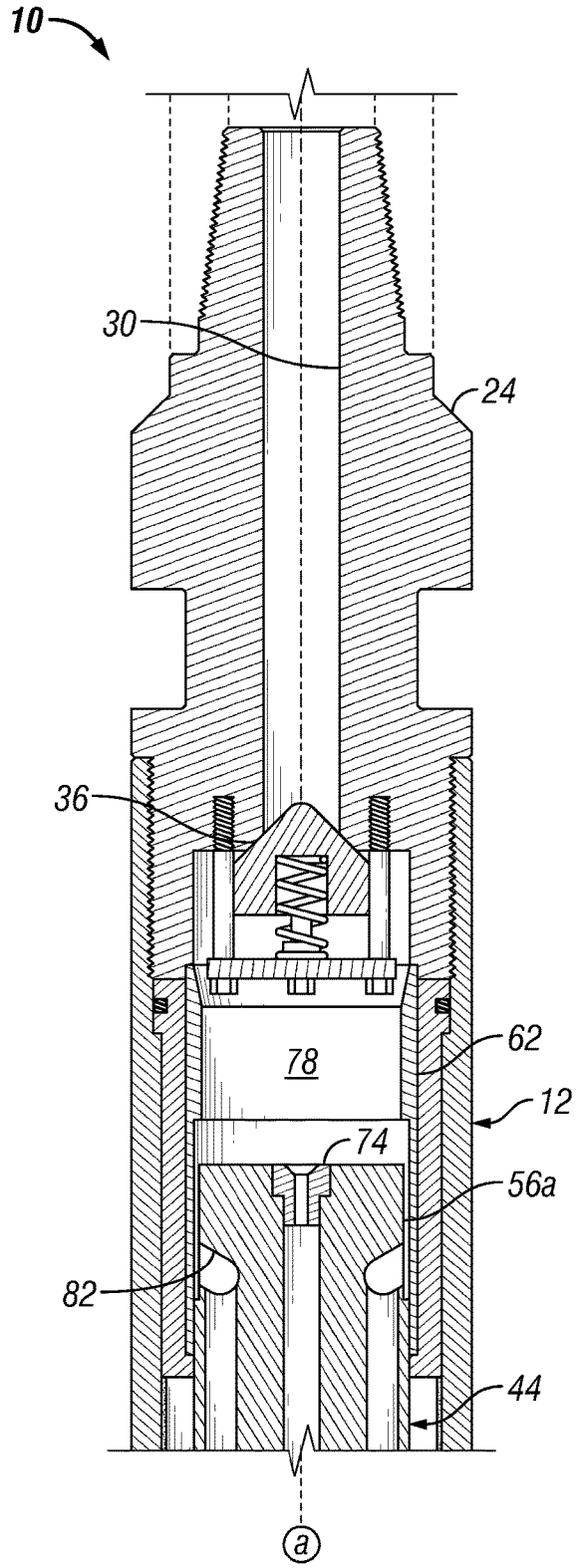
FIG. 1A is a longitudinal cross-sectional view of a portion of a downhole percussion tool in accordance with an exemplary embodiment of the present invention.
Figure 1B:
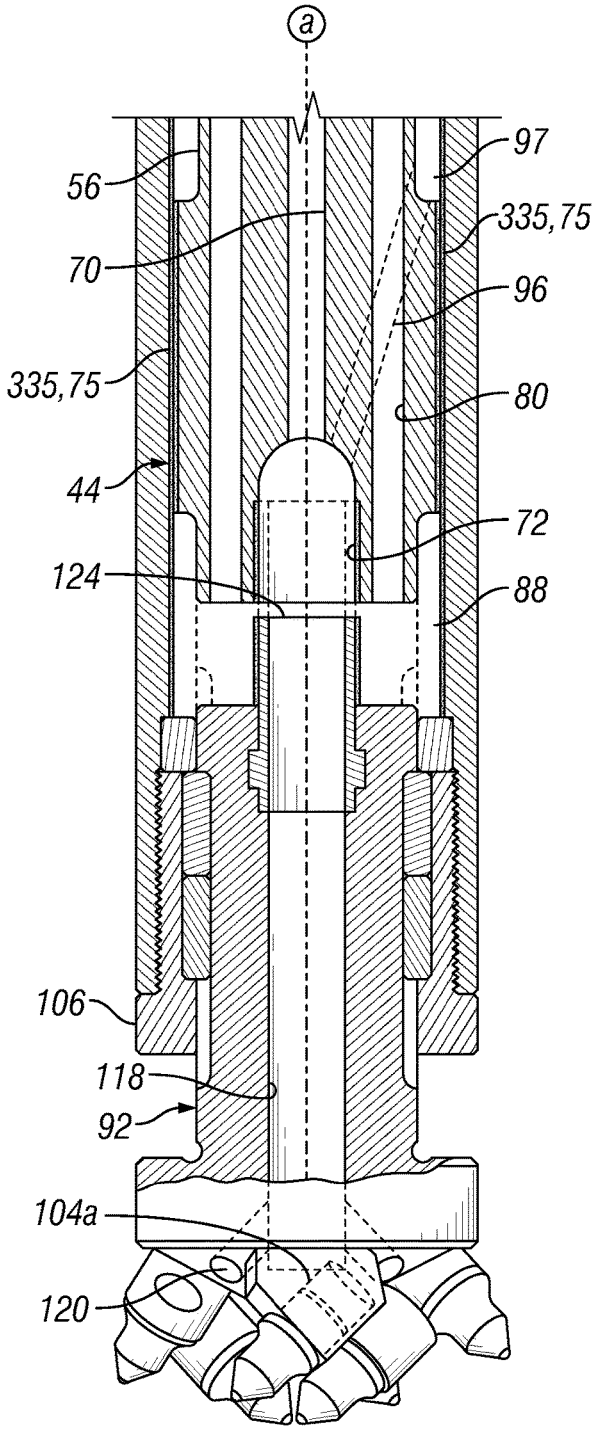
FIG. 1B is a longitudinal cross-sectional view of a remaining portion of the downhole percussion tool of FIG. 1A whereby

FIG. 1A is a longitudinal cross-sectional view of a portion of a downhole percussion tool 10 in accordance with an exemplary embodiment of the present invention. FIG. 1B is a longitudinal cross-sectional view of a remaining portion of the downhole percussion tool 10 of FIG. 1A whereby FIG. 1A is intended to be joined to FIG. 1B along common line a-a. A downhole percussion tool similar to downhole percussion tool 10 is described in detail in U.S. Pat. No. 7,377,338, which issued to Bassinger on May 27, 2008, and is incorporated by reference herein in its entirety. Thus, the downhole percussion tool 10 is briefly described herein for the sake of describing airflow therein, the sliding interaction between parts of the downhole percussion tool 10, and surface modifications and coatings intended to improve its performance. Referring to FIGS. 1A and 1B, the downhole percussion tool 10 includes a tool cylinder or housing 12, a rear adapter or sub 24, a check valve 36, a piston 44, a drive sub 106, and an integrated claw bit 92. Although an integrated claw bit is illustrated within FIG. 1B, a bit sub (not shown) capable of receiving a claw bit, or other bit type, can be used in lieu of the integrated claw bit 92. Once the downhole percussion tool 10 is assembled, a top pressure fluid chamber 78, an annular chamber 97, and a bottom pressure fluid chamber 88 is formed.

The sub 24 includes a sub passage 30 extending longitudinally therein. The check valve 36 is coupled at an end of the sub passage 30 and is positioned within the housing 12 once the sub 24 is threadedly coupled to an end of the housing 12. The check valve 36 allows for pressurized fluid to flow from the sub passage 30 into the housing 12; however, the check valve 36 prevents pressurized fluid from flowing from the housing 12 to the sub passage 30. In conventional downhole percussion tools, tools without the surface modifications and coatings disclosed herein, the pressurized fluid, or pressurized air, included oil injected into it by an oilers sub (not shown). The oil in the pressurized fluid was needed to lubricate the piston 44 and decrease the friction occurring between at least the surface of the piston 44 and the surface of the housing 12 as the piston 44 reciprocates in an up and down motion.

The drive sub 106 is threadedly coupled to an opposing end of the housing 12. The integrated claw bit 92 is movably coupled within the drive sub 106 at the opposing end of the housing 12. The integrated claw bit 92 includes a bit passage 118 extending longitudinally therein and is in communication with one or more secondary bit passages 120, which are in communication with an environment external to the bit 92. The integrated claw bit 92 is capable of moving in at least an axial direction and may be capable of moving in a rotational manner as well. When the integrated claw bit 92 is in contact with the bottom of the formation or when there is a significant upward force acting upon the integrated claw bit 92, the integrated claw bit 92 is in the dash-lined position as shown in FIG. 1B. Conversely, when the integrated claw bit 92 is not in contact with the bottom of the formation or there is no significant upward force acting upon the integrated claw bit 92, the integrated claw bit 92 is in the solid-lined position as shown in FIG. 1B.

The piston 44 is a single-walled tube that includes a piston passage 70 extending substantially centrally therethrough. An orifice plug 74, or choke valve, is positioned within the piston passage 70 at a top end of the piston 44. The piston passage 70 is in fluid communication with piston base passage 72 formed within an opposing end of the piston 44. The piston 44 also includes at least two pressurized fluid inlet ports 82 formed along a top portion of a sidewall of the piston 44 and extending into an interior of the piston 44. The piston 44 further includes pressurized fluid conducting piston passageways 80 extending from the pressurized fluid inlet ports 82 to the opposing end of the piston 44. Piston 44 further includes one or more exhaust passages 96 that extend from the piston base passage 72 to the annular chamber 97 formed between the piston 44 and the housing 12. The exhaust passages 96 are offset from the pressurized fluid conducting piston passageways 80. The piston 44 is movably positioned within the housing 12 and at least a portion of the outer surface of the piston 44 is in frictional contact with the internal surface of the housing 12, and generates frictional forces and heat when moving in a reciprocating manner. Once the piston 44 is properly assembled within the housing 12, the top pressure fluid chamber 78, the annular chamber 97, and the bottom pressure fluid chamber 88 are formed. The top pressure fluid chamber 78 is formed between the one end of the piston 44 having the orifice plug 74 and the check valve 36. The annular chamber 97 is formed between a portion of the perimeter of the piston 44 and the housing 12. The bottom pressure fluid chamber 88 is formed between the opposing end of the piston 44 and the integrated claw bit 92.

During operation of the downhole percussion tool 10, the tool 10 is placed in a position such that the bit 92 is urged upwardly to the position indicated by the dashed lines in FIG. 1B and the piston 44 will be urged to the position shown by the solid lines in FIGS. 1A and 1B. In this position, the flow of high pressure fluid from top pressure fluid chamber 78 to annular chamber 97 is terminated since a reduced diameter portion 56 of the piston 44 is in close fitting relationship with a sleeve 62 positioned within the housing 12 and about the perimeter of a portion of the piston 44. In this condition, pressure fluid is still communicated through pressurized fluid conducting piston passageways 80 to bottom pressure fluid chamber 88 while pressure fluid is vented from annular chamber 97 through exhaust passages 96 to the exterior of the tool 10 by way of the bit passage 118 and secondary bit passages 120. Thus, a resultant force is exerted on the piston 44 driving it upwardly, viewing FIGS. 1A and 1B, until the reduced diameter portion 56*a* of the piston 44 is positioned such that the communication of high pressure fluid to pressurized fluid inlet ports 82, pressurized fluid conducting piston passageways 80, and bottom pressure fluid chamber 88 is cut-off. A resultant pressure fluid force acting on piston 44 will continue to drive the piston 44 upwardly, viewing FIGS. 1A and 1B, until the pressure fluid from bottom pressure fluid chamber 88 is able to vent through bit passage 118 and secondary bit passages 120. This occurs when the bottom of the piston 44 is raised elevationally above the top of a tube 124, which is positioned at least partially within bit passage 118 and extends outwardly from the top of the bit 92. In this condition, a net resultant pressure fluid force acting on the top surface of the piston 44 is sufficient to drive the piston 44 downwardly to deliver an impact blow to the top surface of the bit 92 and the cycle just described will then repeat itself rapidly and in accordance with the design parameters of the tool 10.

According to certain exemplary embodiments, the housing 12 and/or piston 44, have at least a portion of their surface properties modified using a ferritic nitrocarburization heat treat process. In the exemplary embodiment, the modified surfaces 75 are those surfaces that are in a sliding relationship with another part. For example, portions of the internal surface of housing 12 are modified in the areas that engage piston 44 as piston 44 moves within housing 12.

The ferritic nitrocarburization process is known to people having ordinary skill in the art and therefore is not described herein for the sake of brevity. In a preferred ferritic nitrocarburization process, modified surfaces 75 of housing 12 and/or piston 44 are modified using a salt bath ferritic nitrocarburization. One skilled in the art appreciates that salt bath ferritic nitrocarburization is also known as liquid ferritic nitrocarburization or liquid nitro nitrocarburization. Specific salt bath processes are known to those skilled in the art under the trade names Tufftride, Tenifer, Melonite, Nu-Tride, Sursulf, and Tenoplus. Alternatively, surfaces 75 may be modified by gaseous ferritic nitrocarburization. One skilled in the art appreciates that gaseous ferritic nitrocarburization may also be known as controlled nitrocarburization, soft nitriding, and vacuum nitrocarburization. Specific gaseous processes are known to those skilled in the art under the trade names Nitrotec, Nitemper, Deganit, Triniding, Corr-I-Dur, Nitroc, Nitrowear, and Nitroneg. Alternatively, surfaces 75 may be modified by plasma-assisted ferritic nitrocarburization. One skilled in the art appreciates that plasma-assisted ferritic nitrocarburization may also be known as ion nitriding, plasma ion nitriding, or glow-discharge nitriding. Alternatively, surfaces 75 may be modified by austentitic nitrocarburization.

Although surfaces 75 are shown in the figures and referenced, it is understood that all of the internal surfaces of housing 12 and/or piston 44 or portions of the internal surfaces of housing 12 and/or piston 44 may be modified using a ferritic nitrocarburization process. For example, the surfaces modified using a ferritic nitrocarburization process may be limited to those portions subject to the most wear. Additionally, the entire housing 12 and piston 44 (inside and out) may be modified by ferritic nitrocarburization.

Additionally, different parts of housing 12 and piston 44 may be modified by different ferritic nitrocarburization processes. For example, internal surface may be modified using a salt bath processes while other surfaces are modified using a gaseous process. Further, the same or different ferritic nitrocarburization temperatures may be used for different portions of housing 12 and piston 44. For example, it may be advantageous to more tightly control the process temperature with respect to high wear portions of housing 12, such as the internal surfaces that contact piston 44, than for low wear surfaces. The difference in temperature control may result in different processing temperatures.

One or more coatings 335 may also be applied to portions of housing 12 and/or piston 44. Each of the coatings 335 applied thereon provides one or more of the following characteristics when compared to the material used to fabricate the housing 12 and piston 44, such as steel: a) higher abrasion resistance, b) higher lubricity (i.e. lower coefficient of friction), c) improved thermal stability, d) improved chemical stability, e) high adhesion, f) high hardness, and g) high hardness with one or more subsequent coatings 335 having a lower hardness. According to some exemplary embodiments, the one or more of the coatings 335 has a hardness of less than 90 HRC.

According to some exemplary embodiments, the one or more of the coatings 335 has a hardness of less than 80 HRC. According to some exemplary embodiments, the one or more of the coatings 335 has a hardness of less than 70 HRC. According to some exemplary embodiments, at least one coating 335 provides characteristics that meet at least one of the criteria mentioned above. According to some exemplary embodiments, at least one coating 335 provides characteristics that meet at least two of the criteria mentioned above. According to some exemplary embodiments, at least one coating 335 provides characteristics that meet at least three of the criteria mentioned above. According to some exemplary embodiments, at least one coating 335 provides characteristics that meet at least four of the criteria mentioned above. According to some exemplary embodiments, one of the coatings 335 is applied or coupled to the housing 12 and/or piston 44 for the benefit of a second coating 335. For example, a first coating 335 has a better adhesion to the housing 12 and/or piston 44 and to the second coating 335 than a second coating 335 can adhere to the housing 12 and/or piston 44, but the second coating 335 provides a lower friction coefficient than the first coating 335. Thus, the first coating 335 is applied or coupled to the case internal surface 334 and the second coating 335 is applied or coupled to the first coating 335. In another example, one of the coatings 335 may have a better heat transfer coefficient, while another coating 335 has a low coefficient of friction.

According to some exemplary embodiments, the coating 335 is applied or coupled onto the housing 12 and/or piston 44 or onto another coating 335 via a chemical deposition process, an electrolysis process, a vapor deposition process, or some other coating applying process that is known to a person having ordinary skill in the art with the benefit of the present disclosure. The coating 335 may be applied to portions of housing 12 and/or piston 44 that has been modified using a ferritic nitrocarburization process, portions that have not been modified, or both. For example, a coating may be applied to the entire internal surface of housing 12 even though only a portion of the internal surface was modified (modified surfaces 75) using a ferritic nitrocarburization process.

The coating 335 forms a chemical bond to the housing 12 and/or piston 44 according to some exemplary embodiments, but forms a different bond type, such as a metallurgical bond, in other exemplary embodiments. Some examples of coatings 335 include, but are not limited to, chromium based alloys, polytetrafluoroethylene (PTFE or Teflon®), diamond like coatings (DLC) such as polished diamond, carbide composites, and nitride composites. Some examples of carbide composites include, but are not limited to, tungsten carbide, boron carbide, and chromium carbide. Some examples of nitride composites include, but are not limited to, silicon nitride and chromium nitride.

Although surfaces modifications (modified surfaces 75), and coatings 335 are discloses with respect to housing 12 and piston 44, it is understood that surfaces of different components may also be modified and/or coated. For example, FIG. 1B shows tube 124 in a sliding relationship with base passage 72. In one exemplary embodiment, both the surface of base passage 72 and tube 124 are modified using a ferritic nitrocarburization heat treat process as described above with respect to housing 12 and piston 44. The surfaces may also have coatings 335 applied thereto as described with respect to housing 12 and piston 44. In another exemplary embodiment, sleeve 62 is modified using a ferritic nitrocarburization heat treat process as described above with respect to housing 12 and piston 44.

Figure 2:
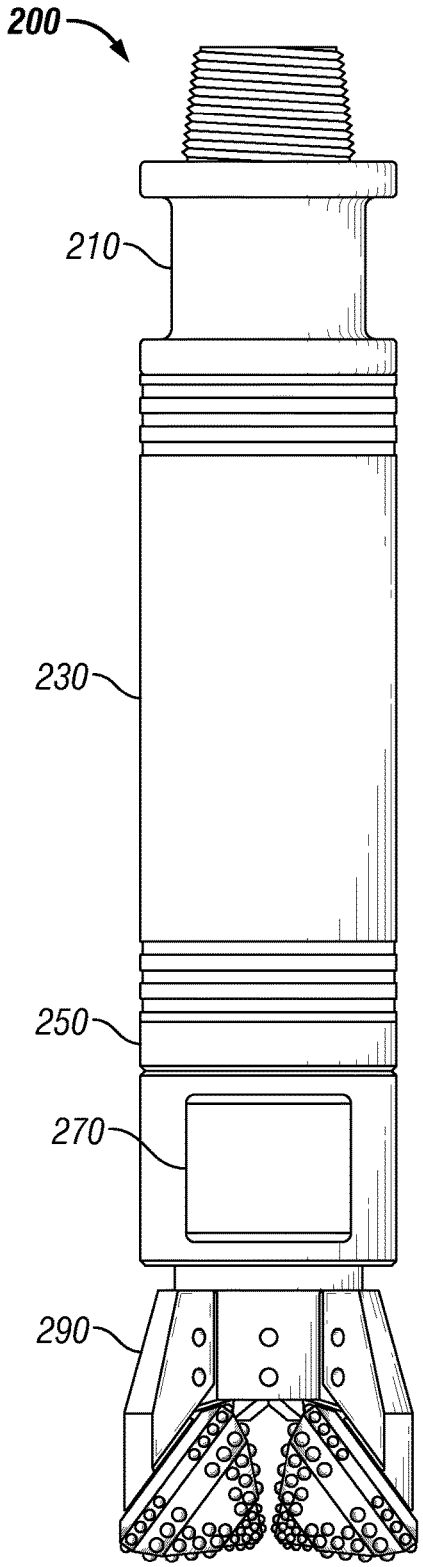
FIG. 2 is a side view of a percussion tool in accordance with an exemplary embodiment of the present invention.
Figure 3:
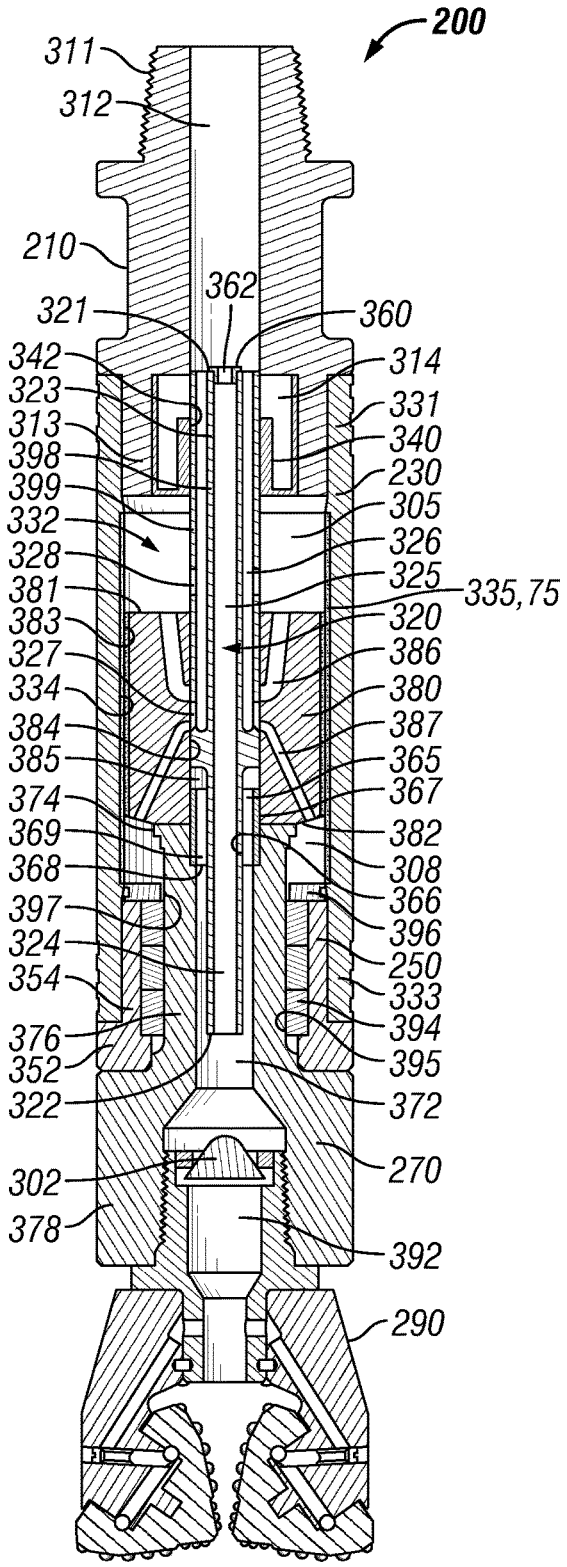
FIG. 3 is a cross-sectional view of the percussion tool of FIG. 2 in accordance with an exemplary embodiment of the present invention.

FIG. 2 is a side view of a percussion tool 200 in accordance with an exemplary embodiment of the present invention. FIG. 3 is a cross-sectional view of the percussion tool 200 in accordance with an exemplary embodiment of the present invention. Referring to FIGS. 2 and 3, the percussion tool 200 includes a top sub 210, a case 230, a drive sub 250, a mandrel 270, and a bit 290, which are viewable and accessible from exterior of the percussion tool 200. The percussion tool 200 further includes a feed tube 320, a feed tube mount 340, a choke 360, a piston 380, one or more drive lugs 394, an exhauster 365, a split retaining ring 396, and a check valve 302, which are all positioned internally of the percussion tool 200. Although certain components have been mentioned, greater or fewer components may be included in the percussion tool 200 without departing from the scope and spirit of the exemplary embodiment. Further, one or more components may be combined or separated from another mentioned component without departing from the scope and spirit of the exemplary embodiment. Once the percussion tool 200 is assembled, a top pressure fluid chamber 305 and a bottom pressure fluid chamber 308 are formed.

The top sub 210 includes a top end 311, a bottom end 313, a sub passage 312 extending longitudinally therein from the top end 311 towards the bottom end 313, and a secondary sub passage 314 extending from the end of the sub passage 312 to the bottom end 313. The top end 311 is threaded and is coupleable to a drill string (not shown) or some other down hole tool according to certain exemplary embodiments. Similarly, the bottom end 313 also is threaded and is coupled to the case 230 according to certain exemplary embodiments. The secondary sub passage 314 is in fluid communication with the sub passage 312. The secondary sub passage 314 is larger in diameter than the sub passage 312 according to some exemplary embodiments. The secondary sub passage 314 houses a portion of the feed tube 320, at least a portion of the feed tube mount 340, and the choke 360 depending upon the length and positioning of the feed tube 320 according to certain exemplary embodiments. In certain other exemplary embodiments, the choke 360 is housed within the sub passage 312 or a combination of the sub passage 312 and the secondary sub passage 314. Although not illustrated in this exemplary embodiment, the check valve 302 is optionally coupled to the top sub 210 either within the sub passage 312 or within the secondary sub passage 314 above the choke 360 and prevents the upward flow of pressurized fluid, such as air, from the top pressure fluid chamber 305 and/or the feed tube 320 to the drill string or other down hole tool positioned above the top sub 210. Hence, in this non-illustrated exemplary embodiment, the check valve 302 allows for pressurized fluid to flow in the direction from the sub passage 312 to the case 230; however, the check valve 302 prevents pressurized fluid from flowing in the opposite direction. In the current exemplary embodiment, however, this check valve 230 is positioned within the bit 290, which is described in further detail below. According to exemplary embodiments, the pressurized fluid includes pressurized air and is absent of any oil particles. According to some exemplary embodiments, some amounts of water is included within the pressurized fluid.

The case 230 is tubularly shaped and includes a top end 331, a bottom end 333, and a case passageway 332 extending from the top end 331 to the bottom end 333. The case passageway 332 is defined by a case internal surface 334 and has a variable internal diameter along its length according to certain exemplary embodiments, however, this internal diameter, or case internal surface 334, does not have a variable diameter along its length in other exemplary embodiments. The top end 331 is threaded and is coupled to the bottom end 313 of the top sub 210. Similarly, the bottom end 333 also is threaded and is coupled to the drive sub 250 according to certain exemplary embodiments. The case 230 houses at least a portion of the top sub 210, the feed tube mount 340, the feed tube 320, the piston 380, one or more drive lugs 394, the exhauster 365, the split retaining ring 396, a portion of the drive sub 250, and a portion of the mandrel 270. Once the components of the percussion tool 200 are assembled, the top pressure fluid chamber 305 and the bottom pressure fluid chamber 308 are formed within the case 230.

According to certain exemplary embodiments, at least a portion of the case internal surface 334, which is or can be in contact with the piston 380, has had its surface properties modified using a ferritic nitrocarburization heat treat process. In a preferred ferritic nitrocarburization process, case internal surface 334 is modified by salt bath ferritic nitrocarburization. The descriptions of various ferritic nitrocarburization processes have been previously described and therefore are not repeated again herein for the sake of brevity.

Although modifying the properties of internal surface 334 is referenced, it is understood that the entire internal surface or portions of internal surface 334 may be modified using a ferritic nitrocarburization process. For example, the surface modified using a ferritic nitrocarburization process may be limited to those portions subject to the most wear. Additionally, the entire case 230 (inside and out) may be modified by ferritic nitrocarburization.

Additionally, different surface areas of case 230 and/or internal surface 334 may be modified by different ferritic nitrocarburization processes. For example, internal surface 334 may be modified using a salt bath processes while other surfaces are modified using a gaseous process. Further, the same or different ferritic nitrocarburization temperatures may be used for different portions of case 230 or internal surface 334. For example, it may be advantageous to more tightly control the process temperature with respect to high wear portions of case 230, such as internal surface 334, than for low wear surfaces.

According to some exemplary embodiments, one or more coatings 335 may also be applied or coupled to case 230, internal surface 334, or portions of both. The description and characteristics of the one or more coatings 335 have been previously described and therefore are not repeated again herein for the sake of brevity. The coating 335 is applied or coupled onto the casing 230 or onto another coating 335 via a chemical deposition process, an electrolysis process, a vapor deposition process, or some other coating applying process that is known to a person having ordinary skill in the art with the benefit of the present disclosure. The coating 335 may be applied to portions of casing 230 that have been modified using a ferritic nitrocarburization process, portions that have not been modified, or both. For example, a coating may be applied to the entire internal surface 334 even though only a portion of internal surface 334 was modified using a ferritic nitrocarburization process. The coating 335 forms a chemical bond to the casing 230 and/or to another coating 335 according to some exemplary embodiments, but forms a different bond type, such as a metallurgical bond, in other exemplary embodiments. Some examples of coatings 335 include, but are not limited to, chromium based alloys, polytetrafluoroethylene (PTFE or Teflon®), diamond like coatings (DLC) such as polished diamond, carbide composites, and nitride composites. Some examples of carbide composites include, but are not limited to, tungsten carbide, boron carbide, and chromium carbide. Some examples of nitride composites include, but are not limited to, silicon nitride and chromium nitride.

The drive sub 250 is tubularly shaped and includes a first portion 352 and a second portion 354. The first portion 352 has an outer diameter equal to the outer diameter of the case 230. The second portion 354 extends substantially orthogonally away from the first portion 352 and has an outer diameter less than the outer diameter of the first portion 352 and an inner diameter greater than the inner diameter of the first portion 352. According to certain exemplary embodiments, the second portion 354 is threaded and coupled to the bottom end 333 of the case 230. Once the drive sub 250 is assembled to the case 230, the outer surfaces of both the first portion 352 of the drive sub 250 and the case 230 are substantially aligned. The drive sub 250 houses the one or more drive lugs 394 and a portion of the mandrel 270 and the feed tube 320.

The mandrel 270 is a substantially solid component having a mandrel passageway 372 extending axially therethrough. The mandrel passageway 372 houses a portion of the feed tube 320 and is in fluid communication with the sub passage 312 via the feed tube 320, which is described in greater detail below. The mandrel 270 further includes a top portion 374, a bottom portion 378, and a middle portion 376 extending from the top portion 374 to the bottom portion 378. The middle portion 376 has an outer diameter less than the outer diameters of both the top portion 374 and the bottom portion 378. The bottom portion 378 has an outer diameter equal to the outer diameter of the first portion 352 of the drive sub 250. Further, the top portion 374 has an outer diameter less than the outer diameter of the bottom portion 378 and greater than the outer diameter of the middle portion 376. The mandrel 270 houses a portion of the feed tube 320 and at least a portion of the exhauster 365. Once the mandrel 270 is assembled to form the percussion tool 200, the mandrel 270 is axially moveable with respect to both the case 230 and the drive sub 250 and a portion of the mandrel 270 is inserted and housed within the case 230. The bottom portion 378 of the mandrel 270 is positioned adjacent to the first portion 352 of the drive sub 250 when the bit 290 is placed within the formation in contact with the bottom of the hole and with a downward force applied onto the bottom of the hole. However, the bottom portion 378 of the mandrel 270 is not positioned adjacent to the first portion 352 of the drive sub 250 when the bit 290 is placed within the formation and is not in contact with the bottom of the hole. The mandrel passageway 372 has a larger diameter at the bottom portion 378 of the mandrel 270 and is configured to receive a portion of the bit 290 therein according to certain exemplary embodiments. In certain of these exemplary embodiments, the lower portion of the mandrel passageway 372 is threaded and engages with a portion of the bit 290. However, in alternative exemplary embodiments, the bit 290 and the mandrel 270 are formed as an integral component, such as when the percussion tool includes a hammer bit.

Bit 290 is a roller cone bit that is coupled to the mandrel 270 within the lower portion of the mandrel passageway 372 according to certain exemplary embodiments. The bit 290 is threadedly engaged to the mandrel 270 according to some exemplary embodiments. Although the bit 290 is illustrated as a roller cone bit in certain exemplary embodiments, the bit 290 is a different type of bit, such as a polycrystalline diamond cutter (PDC) bit, or other type of drag bit or fixed cutter bit. Alternatively, in other exemplary embodiments, the bit 290 is integrally formed with the mandrel 270, such as a hammer bit, as a single component. Bit 290 includes a bit passageway 392 extending therein and in fluid communication with the mandrel passageway 372. The bit passageway 392 communicates pressurized fluid, such as air, from the mandrel passageway 372 to an environment external of the bit 290. Further, according to certain exemplary embodiments, the check valve 302 is coupled within the bit passageway 392 of the bit 290. The check valve 302 is designed to allow flow from the mandrel passageway 372 to the environment external to the bit 290; however, the check valve 302 prevents flow in the reverse direction. As previously mentioned, according to some alternative exemplary embodiments, this check valve 302 is positioned upstream, or vertically above, the choke 360.

As previously mentioned, the percussion tool 200 further includes the feed tube 320, the feed tube mount 340, the choke 360, the piston 380, one or more drive lugs 394, the exhauster 365, and the split retaining ring 396. According to certain exemplary embodiments, the feed tube 320 is a double-wall feed tube and is tubular in shape. The feed tube 320 includes a top end 321, a bottom end 322, an upper portion 323, and a lower portion 324. The feed tube 320 also includes an inner wall 398 and an outer wall 399. The upper portion 323 extends from the top end 321 towards the bottom end 322 and the lower portion 324 extends from the upper portion 323 to the bottom end 322. According to certain exemplary embodiments, the upper portion 323 has a greater outer diameter than the lower portion 324. The feed tube 320 includes a central feed tube channel 325 extending from the top end 321 to the bottom end 322 and is defined by the inner wall 398. The central feed tube channel 325 communicates pressurized fluid from the sub passage 312 to the mandrel passageway 372. The feed tube 320 also includes an outer feed tube channel 326, which extends from the top end 321 towards the lower portion 324, but remains within the upper portion 323 according to certain exemplary embodiments. The outer feed tube channel 326 is defined by the outer wall 399 and the inner wall 398 and is positioned therebetween. However, in other exemplary embodiments, the outer feed tube channel 326 extends into the lower portion 324 but not through the feed tube 320. The outer feed tube channel 326 circumferentially surrounds a portion of the length of the central feed tube channel 325; however, in other exemplary embodiments, the outer feed tube channel 326 does not circumferentially surround a portion of the central feed tube channel 325. For example, the outer feed tube channel 326 may be a single channel extending from the top end 321 or may be several discrete channels extending from the top end 321. Additionally, the feed tube 320 includes one or more first openings 327 and one or more second openings 328 positioned about the perimeter of the upper portion 323 through the outer wall 399. However, in other exemplary embodiments, some or all of these openings 327, 328 are positioned about the perimeter of the lower portion 324 when the outer feed tube channel 326 extends into the lower portion 324. The first openings 327 communicate pressurized fluid from within the outer feed tube channel 326 to the bottom pressure fluid chamber 308 through an interior of the piston 380, while the second openings 328 communicate pressurized fluid from within the outer feed tube channel 326 to the top pressure fluid chamber 305 via the interior of the piston 380. According to some exemplary embodiments, the first openings 327 are radially aligned with one another at substantially the same elevation; however, in other exemplary embodiments, one or more first openings 327 are not radially aligned with one another at the same elevation. Similarly, according to some exemplary embodiments, the second openings 328 are radially aligned with one another at substantially the same elevation; however, in other exemplary embodiments, one or more second openings 328 are not radially aligned with one another at the same elevation. Yet, in other exemplary alternative exemplary embodiments, there are only one or more first openings 327 and no second openings 328 as the first openings are configured to convey pressurized fluid either to the bottom pressure fluid chamber 308 or to the top pressure fluid chamber 305 depending upon the elevational positioning of the piston 380. In other exemplary embodiments, the first openings 327 communicate pressurized fluid from within the outer feed tube channel 326 to the top pressure fluid chamber 305 through an interior of the piston 380, while the second openings 328 communicate pressurized fluid from within the outer feed tube channel 326 to the bottom pressure fluid chamber 308 via the interior of the piston 380.

The feed tube 320 extends from within a portion of the top sub 210 to within a portion of the mandrel 270 and facilitates the communication of pressurized fluid from the sub passage 312 of the top sub 210 to the mandrel passageway 372 of the mandrel 270 and also facilitates the communication of pressurized fluid from the sub passage 312 of the top sub 210 to either to the bottom pressure fluid chamber 308 or to the top pressure fluid chamber 305 depending upon the elevational positioning of the piston 380. According to some exemplary embodiments, the top end 321 of the feed tube 320 extends into the sub passage 312. According to some exemplary embodiments, the outer diameters of the top end 321 of the feed tube 320 and the sub passage 312 are substantially the same such that the top end 321 frictionally fits within the sub passage 312. The feed tube 320 is surrounded by a portion of the top sub 210, the casing 230, a portion of the drive sub 250, a portion of the mandrel 270, the feed tube mount 340, the piston 380, the one or more drive lugs 394, the exhauster 365, and the split retaining ring 396. According to certain exemplary embodiments, the feed tube 320 is fixedly coupled within the interior of the percussion tool 200 using at least one of the feed tube mount 340 and/or the exhauster 365. For example, in one or more exemplary embodiments, the feed tube 320 frictionally fits within the feed tube mount 340 and/or the exhauster 365.

According to some exemplary embodiments, at least a portion of the outer wall 399, which is or can be in contact with the piston 380, has had its surface properties modified using a ferritic nitrocarburization heat treat process. In a preferred ferritic nitrocarburization process, outer wall 399 is modified using a salt bath ferritic nitrocarburization. The descriptions of various ferritic nitrocarburization processes have been previously described and therefore are not repeated again herein for the sake of brevity.

Although modifying the properties of outer wall 399 is referenced, it is understood that the entire outer wall 399 or portions of outer wall 399 may be modified using a ferritic nitrocarburization process. For example, the surface modified using a ferritic nitrocarburization process may be limited to those portions subject to the most wear. Additionally, the entire feed tube 320 (inside and out) may be modified by ferritic nitrocarburization.

Additionally, different parts of feed tube 320 may be modified by different ferritic nitrocarburization processes. For example, the upper end may be modified using a salt bath processes while the lower end is modified using a gaseous process. Additionally, the same or different ferritic nitrocarburization temperatures may be used for different portions of feed tube 320. For example, it may be advantageous to more tightly control the process temperature with respect to high wear portions of feed tube 320, such as outer wall 399, than low wear portions of feed tube 320, resulting in different processing temperatures.

The outer wall 399 may also include one or more coatings 335 applied or coupled thereon. The description and characteristics of the one or more coatings 335 have been previously described and therefore are not repeated again herein for the sake of brevity. The coating 335 may be applied to portions of the feed tube 320 that have been modified using a ferritic nitrocarburization process, portions that have not been modified, or both. For example, a coating may be applied to the entire internal surface 334 even though only a portion of internal surface 334 has been modified using a ferritic nitrocarburization process.

The coating 335 is applied or coupled onto feed tube 320 or onto another coating 335 via a chemical deposition process, an electrolysis process, a vapor deposition process, or some other coating applying process that is known to a person having ordinary skill in the art with the benefit of the present disclosure. The coating 335 may be applied to portions of feed tube 320 that have been modified using a ferritic nitrocarburization process, portions that have not been modified, or both. For example, a coating may be applied to the entire internal surface 334 even though only a portion of internal surface 334 was modified using a ferritic nitrocarburization process. The coating 335 forms a chemical bond to the feed tube 320 and/or to another coating 335 according to some exemplary embodiments, but forms a different bond type, such as a metallurgical bond, in other exemplary embodiments. Some examples of coatings 335 include, but are not limited to, chromium based alloys, polytetrafluoroethylene (PTFE or Teflon®), diamond like coatings (DLC) such as polished diamond, carbide composites, and nitride composites. Some examples of carbide composites include, but are not limited to, tungsten carbide, boron carbide, and chromium carbide. Some examples of nitride composites include, but are not limited to, silicon nitride and chromium nitride.

The feed tube mount 340 is annularly shaped with a feed tube mount passageway 342 extending longitudinally therethrough according to certain exemplary embodiments. The feed tube mount 340 is positioned within the secondary sub passage 314 according to some exemplary embodiments, but can be positioned elsewhere, such as within the top pressure fluid chamber 305 in other exemplary embodiments. The feed tube mount passageway 342 receives at least a portion of the feed tube 320 and may assist in mounting the feed tube 320 within the percussion tool 200. According to certain exemplary embodiments, the feed tube 320 extends entirely through the feed tube mount 340.

The choke 360 also is annularly shaped and forms a plug that fits into the central feed tube channel 325 at the top end 321 of the feed tube 320. The choke 360 includes a choke passageway 362 formed longitudinally therethrough. The dimension, or diameter, of this choke passageway 362 limits the amount of pressurized fluid flowing into the central feed tube channel 325 from the sub passage 312. The pressurized fluid generally flows from the sub passage 312 into the outer feed tube channel 326 and then into either the bottom pressure fluid chamber 308 or to the top pressure fluid chamber 305 depending upon the elevational positioning of the piston 380. However, the excess pressurized fluid flows into the central feed tube channel 325 through the choke 360. The choke 360 is replaceable depending upon the desired restriction, which determines the amount of pressurized fluid that flows into the central feed tube channel 325 through the choke 360. For example, less pressurized fluid flows into the central feed tube channel 325 through the choke 360 when the dimension, or diameter, of the choke passageway 362 is small when compared to when the dimension, or diameter, of the choke passageway 362 is larger. The replacement of the choke 360 is fairly simple and does not require several components of the percussion tool 200 to be dismantled. The top sub 210, along with the remaining components of the percussion tool 200 positioned below the top sub 210, is threadedly removed, or disengaged, from the drill string, or other down hole tool, that it is coupled to. Once the top sub 210 is disengaged, an operator is able to remove the choke 360 by accessing it through the sub passage 312 from the top end 311. Once the operator removes the choke 360, the operator is able to install a different choke of a different size, or the same size if choke 360 has been damaged, depending upon the operating requirements through the same sub passage 312 from the top end 311. Once the choke 360 has been replaced, the top sub 210, along with the remaining attached components, are threadedly coupled, or re-engaged, to the drill string, or other down hole tool, that it is to be coupled to.

Piston 380 is annularly shaped and includes a top end 381, a bottom end 382, an exterior surface 383, and an interior surface 384 that defines a piston passageway 385 extending longitudinally through the piston 380. The piston 380 further includes at least one first pressurized fluid conduit 386 that extends from the interior surface 384 to the top end 381 and at least one second pressurized fluid conduit 387 that extends from the interior surface 384 to the bottom end 382. Further, the piston 380 includes at least one top exhaust conduit 430 (FIG. 4B-2) that extends from the top end 381 to a lower portion of the interior surface 384 such that the top exhaust conduit 430 (FIG. 4B-2) can communicate pressurized fluid from the top pressure fluid chamber 305 to the exhauster 365 when the at least one second pressurized fluid conduit 387 communicates pressurized fluid to the bottom pressure fluid chamber 308. The piston 380 is positioned within the case passageway 332 such that the interior surface 384 is positioned slidably and in contact with the feed tube 320 and the exterior surface 383 is positioned slidably and in contact with the casing 230. Once the piston 380 is slidably positioned within the case passageway 332, the top pressure fluid chamber 305 is formed within the case passageway 332 adjacently above the top end 381 and the bottom pressure fluid chamber 308 is formed within the case passageway 332 adjacently below the bottom end 382. As the piston slidably moves upward towards the top sub 210, the volume of the top pressure fluid chamber 305 decreases while the volume of the bottom pressure fluid chamber 308 increases. Conversely, as the piston 380 slidably moves downward towards the mandrel 270, the volume of the top pressure fluid chamber 305 increases while the volume of the bottom pressure fluid chamber 308 decreases. The piston 380 is used to deliver a downward force onto the mandrel 270 when the bottom end 382 makes downward contact with the mandrel 270. The piston 380 is forced back up and then cycles down again to make contact with the mandrel 270. This cycling of the piston 380 continues until the flow of pressurized fluid through the outer feed tube channel 326 is stopped. The details of this piston 380 operation is provided below in conjunction with FIGS. 4A-J in accordance with one or more exemplary embodiments.

According to some exemplary embodiments, the exterior surface 383 and/or the interior surface 384 have had their surface properties modified using a ferritic nitrocarburization heat treat process. In a preferred ferritic nitrocarburization process, exterior surface 383 and/or the interior surface 384 are modified using a salt bath ferritic nitrocarburizating. The descriptions of various ferritic nitrocarburizating processes have been previously described and therefore are not repeated again herein for the sake of brevity.

Although modifying the properties of exterior surface 383 and/or the interior surface 384 is referenced, it is understood that the entire exterior surface 383 and/or the interior surface 384 or portions of the exterior surface 383 and/or the interior surface 384 may be modified by a ferritic nitrocarburization process. For example, the surface modified by a ferritic nitrocarburization process may be limited to those portions subject to the most wear. Additionally, the entire piston 380 may be modified by ferritic nitrocarburization.

Additionally, different parts of piston 380 may be modified by different ferritic nitrocarburizion processes. For example, the exterior surface 383 may be modified using a salt bath processes while the interior surface 384 is modified using a gaseous process. Additionally, the same or different ferritic nitrocarburization temperatures may be used for different portions of piston 380. For example, it may be advantageous to more tightly control the process temperature with respect to high wear portions of piston 380, such as outer wall 383, than low wear portions, resulting in different processing temperatures.

After the exterior surface 383 and/or the interior surface 384 have been modified, at least a portion of the exterior surface 383 and/or the interior surface 384 may include one or more coatings 335 applied or coupled thereon. The description and characteristics of the one or more coatings 335 have been previously described and therefore are not repeated again herein for the sake of brevity. According to some exemplary embodiments, the case internal surface 334, the exterior surface 383 of the piston 380, or both have one or more coatings 335 applied or coupled thereon. According to some exemplary embodiments, the outer wall 399 of the feed tube 320, the interior surface 384 of the piston 380, or both have one or more coatings 335 applied or coupled thereon.

Accordingly, pursuant to some exemplary embodiments, for example, one or more coatings 335 are applied to at least one of the exterior surface 383 of the piston 380 and casing 230 and/or the interior surface 384 of the piston 380 and the exterior surface of the feed tube 320, which may be applied as a single layer on one or more surfaces and/or as a plurality of layers on one or more surfaces. Hence, in some examples, the initial first coating 335, such as a diamond-like-carbon ("DLC") coating, applied to the one or more surfaces is harder than the material used to fabricate that component. In some instances, there are additional coatings 335 applied onto the first coating 335 that may be softer, such as PTFE. Thus, the exposed coating 335 on at least one of the surfaces, between the exterior surface 383 of the piston 380 and casing 230 and/or the interior surface 384 of the piston 380 and the exterior surface of the feed tube 320, is harder. In another instance, the exposed coating 335 on at least one of the surfaces, between the exterior surface 383 of the piston 380 and casing 230 and/or the interior surface 384 of the piston 380 and the exterior surface of the feed tube 320, is softer. These are only some examples of the coatings 335, however, the coatings 335 can address one or more different properties as mentioned above.

One or more drive lugs 394 are annularly shaped, stacked on top of one another, and positioned between and in contact with the second portion 354 of the drive sub 250 and the middle portion 376 of the mandrel 270. Each drive lug 394 includes a drive lug passageway 395 that extends longitudinally therethrough and receives a portion of the mandrel 270 therein. Specifically, once the drive lugs 394 and the mandrel 270 are properly installed, the middle portion 376 of the mandrel 270 slidably engages with the one or more drive lugs 394 through the drive lug passageway 395. When an upward force is placed onto the bottom of the bit 290, the mandrel 270 slidably moves toward the top sub 210 such that the bottom portion 378 of the mandrel 270 and the drive sub 250 are adjacent and/or in contact with one another. Conversely, when an upward force is not placed onto the bottom of the bit 290, the mandrel 270 slidably moves away the top sub 210 such that the bottom portion 378 of the mandrel 270 and the drive sub 250 are not adjacent and/or not in contact with one another. According to the exemplary embodiment, three drive lugs 394 are shown; however, greater or fewer drive lugs 394 are used in other exemplary embodiments.

The split retaining ring 396 also is annularly shaped, stacked on top of one of the drive lugs 394 and the second portion 354 of the drive sub 250, and positioned between and in contact with the lower portion of the case 230 and the middle portion 376 of the mandrel 270 The split retaining ring 396 includes a split retaining ring passageway 397 that extends longitudinally therethrough and receives a portion of the mandrel 270 therein. Specifically, once the split retaining ring 396 and the mandrel 270 are properly installed, the middle portion 376 of the mandrel 270 slidably engages with the split retaining ring 396 through the split retaining ring passageway 397. When an upward force is placed onto the bottom of the bit 290, the mandrel 270 slidably moves toward the top sub 210 such that the top portion 374 of the mandrel 270 and the split retaining ring 396 are not adjacent and/or in contact with one another. Conversely, when an upward force is not placed onto the bottom of the bit 290, the mandrel 270 slidably moves away the top sub 210 such that the top portion 374 of the mandrel 270 and the split retaining ring 396 are adjacent and/or in contact with one another. The split retaining ring 396 prevents the mandrel 270 and the bit 290 from disengaging from the remaining components of the percussion tool 200, such as the casing 230. According to the exemplary embodiment, a single split retaining ring 396 is shown; however, greater number of split retaining rings 396 are used in other exemplary embodiments.

The exhauster 365 also is annularly shaped and is doubled-walled in accordance with some exemplary embodiments. The exhauster 365 includes an inner wall 366 and an outer wall 367. The inner wall 366 is tubularly shaped and defines an exhauster inner passageway 368 that extends longitudinally therethrough. The exhauster inner passageway 368 receives a portion of the lower portion 324 of the feed tube 320, which extends through the entire exhauster inner passageway 368. According to certain exemplary embodiments, the inner wall 366 provide some support to the feed tube 320. The outer wall 367 also is tubularly shaped and surrounds the inner wall 366. The outer wall 367 and the inner wall 366 collectively define an exhauster outer passageway 369 that extends longitudinally through the exhauster 365. The exhauster outer passageway 369 provides a pathway to exhaust pressurized fluid from the top fluid pressure chamber 305, through the piston 380, and into mandrel passageway 372 so that the pressurized fluid may exit to the external environment as the piston 380 moves upwardly towards the top sub 210. The exhauster 365 is positioned around a portion of the feed tube 320 and located between the feed tube 320 and a portion of the mandrel 270 and a portion of the piston 380 when the piston 380 is at its lower position. When the piston moves to its lower position, i.e. towards the mandrel 270, a portion of the exhauster 365 slides into the piston passageway 385, thereby preventing the exhaust of pressurized fluid from the bottom fluid pressure chamber 308.

Figures 2, 4B:
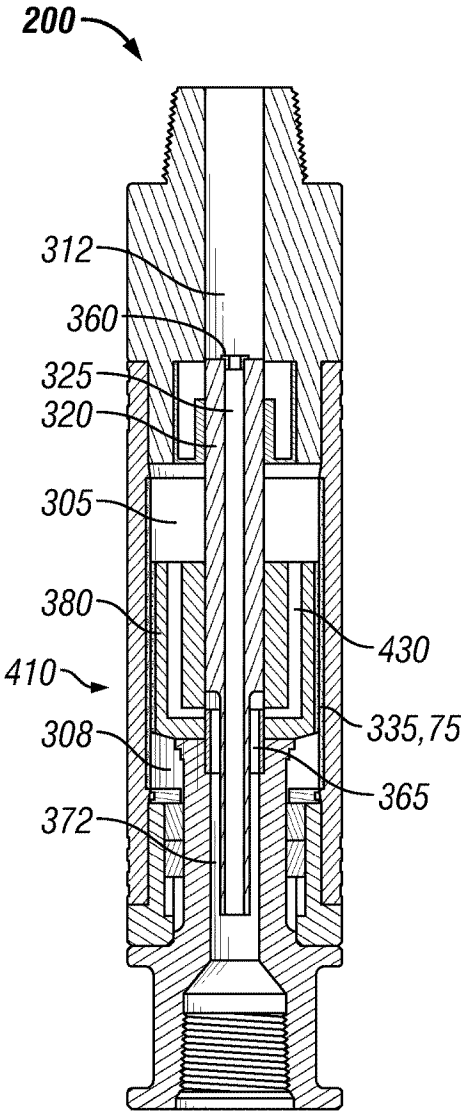
Figures 1, 4B:
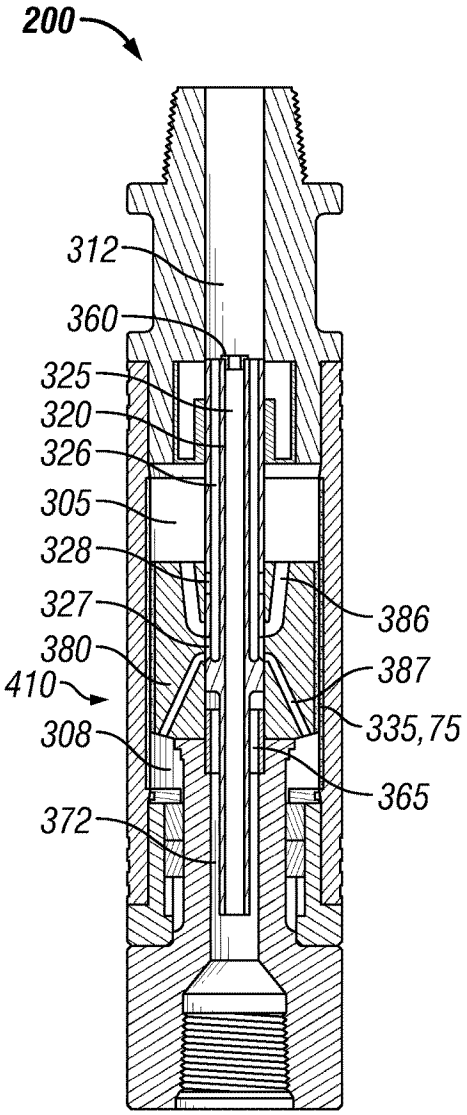
Figure 4A:
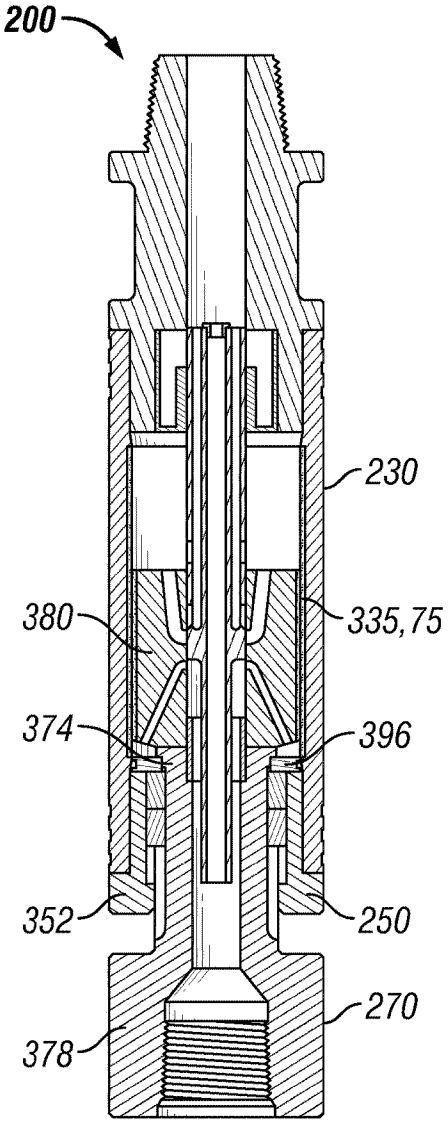

FIGS. 4A-4J-2 are cross-sectional views of the percussion tool 200 without the bit 290 (FIG. 2) illustrating the operation of the percussion tool 200 in accordance with an exemplary embodiment of the present invention. Specifically, FIG. 4A is a cross-sectional view of the percussion tool 200 when no upward force is exerted on the mandrel 270 in accordance with an exemplary embodiment of the present invention. Referring to FIG. 4A and as previously mentioned, the bottom portion 378 of the mandrel 270 is not positioned adjacent to the first portion 352 of the drive sub 250 when the bit 290 (FIG. 2) is placed within the formation and is not in contact with the bottom of the hole, for example, when an upward force is not exerted on the mandrel 270. Further, the top portion 374 of the mandrel 270 is in contact with the split retaining ring 396 and is prevented from being disengaged from the remaining components of the percussion tool 200. Hence, the mandrel 270 remains housed within at least a portion of the casing 230. Additionally, the piston 380 is positioned adjacently and in contact with the top portion 374 of the mandrel 270. However, once an upward force is exerted on the bottom of the mandrel 270, such as when the bit 290 (FIG. 2) is in contact with the bottom of the hole during drilling and as shown in each of FIGS. 4B-1-4J-2, the bottom portion 378 of the mandrel 270 is positioned adjacently and in contact with the first portion 352 of the drive sub 250.

For convenience purposes, it is assumed that an upward force is exerted on the bottom of the mandrel 270 in each of FIGS. 4B-1-4J-2 and therefore is not reiterated in the descriptions for each of those figures. Further, the non-illustration of the bit 290 (FIG. 2) in each of FIGS. 4B-1-4J-2 is not reiterated in the description for each of those figures. Either a bit, such as bit 290 (FIG. 2) is coupled to the mandrel 270 or an integrated bit, such as a hammer, is formed with the mandrel 270.

FIG. 4B-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4B-2 is a cross-sectional view of the percussion tool 200 with the piston 380 in the down position 410 and showing the positioning of the at least one top exhaust conduit 430 in accordance with an exemplary embodiment of the present invention. Referring to FIGS. 4B-1 and 4B-2, the piston 380 is positioned in the down position 410 and facilitates forming the top pressure fluid chamber 305 above it and the bottom pressure fluid chamber 308 below it, where the bottom pressure fluid chamber 308 is smaller in volume than the top pressure fluid chamber 305. At this down position 410, the second pressurized fluid conduits 387 within the piston 380 are in fluid communication with at least one respective first opening 327 of the feed tube 320 and hence is able to communicate pressurize fluid from the outer feed tube channel 326 to the bottom pressure fluid chamber 308. However, at this down position 410, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this down position 410. As the bottom pressure fluid chamber 308 is filled and the pressure therein increases, the piston 380 commences rising, thereby decreasing the volume of the top pressure fluid chamber 305 and increasing the volume of the bottom pressure fluid chamber 308. The pressurized fluid within the bottom pressure fluid chamber 308 does not exhaust through the exhauster 365 when the piston 380 is at this down position 410. As the volume on the top pressure fluid chamber 305 decreases, the fluid therein is exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid enters only the bottom pressure fluid chamber 308 and therefore is not used to counteract, or work against, itself when being used to move the piston 380.

Figures 1, 4C:
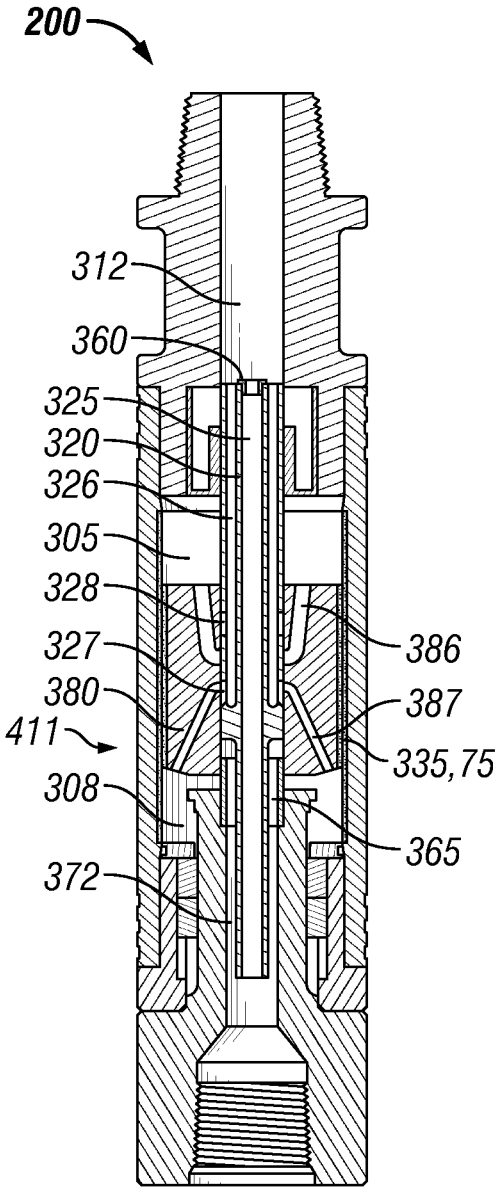
Figures 2, 4C:
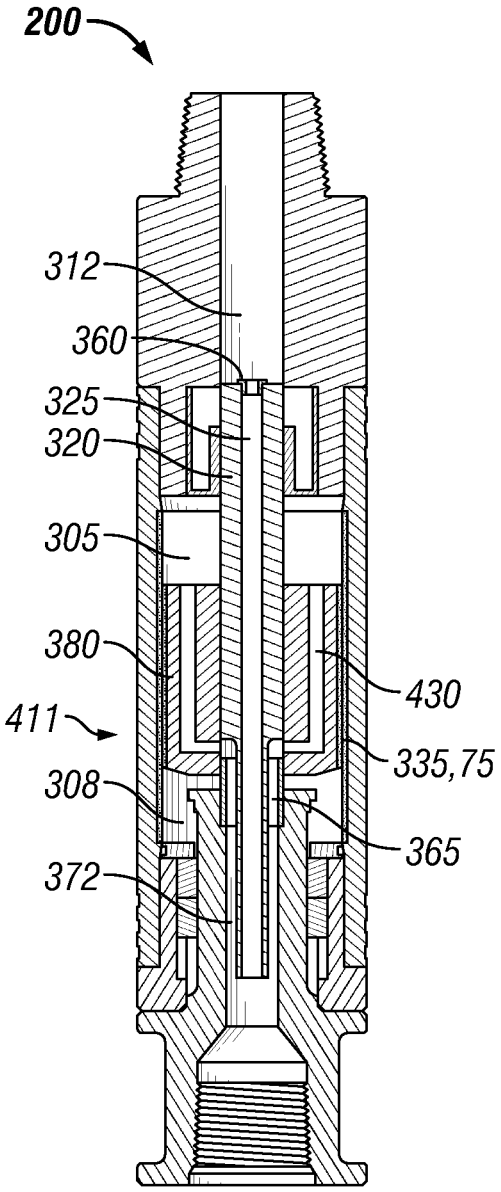

FIG. 4C-1 is a cross-sectional view of the percussion tool 200 with the piston 380 in a first intermediate upward moving position 411 and showing the positioning of the at least one first pressurized fluid conduit 386 and the at least one second pressurized fluid conduit 387 in accordance with an exemplary embodiment of the present invention. FIG. 4C-2 is a cross-sectional view of the percussion tool 200 with the piston 380 in the first intermediate upward moving position 411 and showing the positioning of the at least one top exhaust conduit 430 in accordance with an exemplary embodiment of the present invention. Referring to FIGS. 4C-1 and 4C-2, the piston 380 is positioned in the first intermediate upward moving position 411 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the down position 410 (FIG. 4B-1). At this first intermediate upward moving position 411, the second pressurized fluid conduits 387 within the piston 380 are still in fluid communication with at least one respective first opening 327 of the feed tube 320 and hence still communicates pressurize fluid from the outer feed tube channel 326 to the bottom pressure fluid chamber 308. However, at this first intermediate upward moving position 411, the first pressurized fluid conduits 386 within the piston 380 are not in fluid communication with any of the second openings 328 of the feed tube 320 and hence is not able to communicate pressurize fluid from the outer feed tube channel 326 to the top pressure fluid chamber 305. Thus, only the bottom pressure fluid chamber 308 is filled with pressurized fluid while the top pressure fluid chamber 305 is not, when the piston 380 is at this first intermediate upward moving position 411. As the bottom pressure fluid chamber 308 continues to be filled and the pressure therein increases, the piston 380 continues rising, thereby further decreasing the volume of the top pressure fluid chamber 305 and further increasing the volume of the bottom pressure fluid chamber 308. The pressurized fluid within the bottom pressure fluid chamber 308 still does not exhaust through the exhauster 365 when the piston 380 is at this first intermediate upward moving position 411. As the volume on the top pressure fluid chamber 305 continues to decrease, the fluid therein continues to be exhausted to the outside environment through the at least one top exhaust conduit 430. This fluid proceeds from the top pressure fluid chamber 305, into the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the bottom pressure fluid chamber 308 and therefore is not used to counteract, or work against, itself when being used to move the piston 380.

Figures 1, 4D:
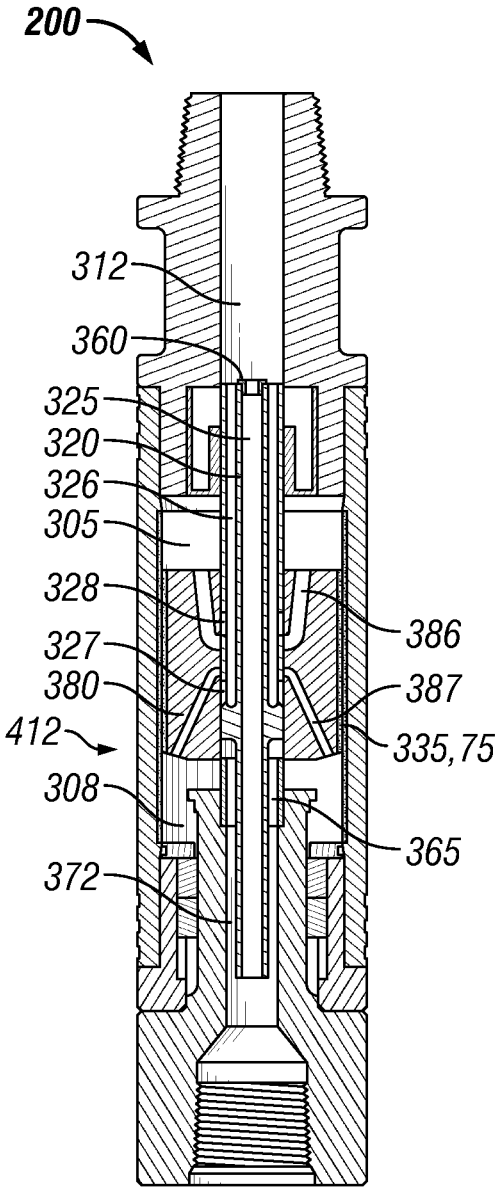
Figures 2, 4D:
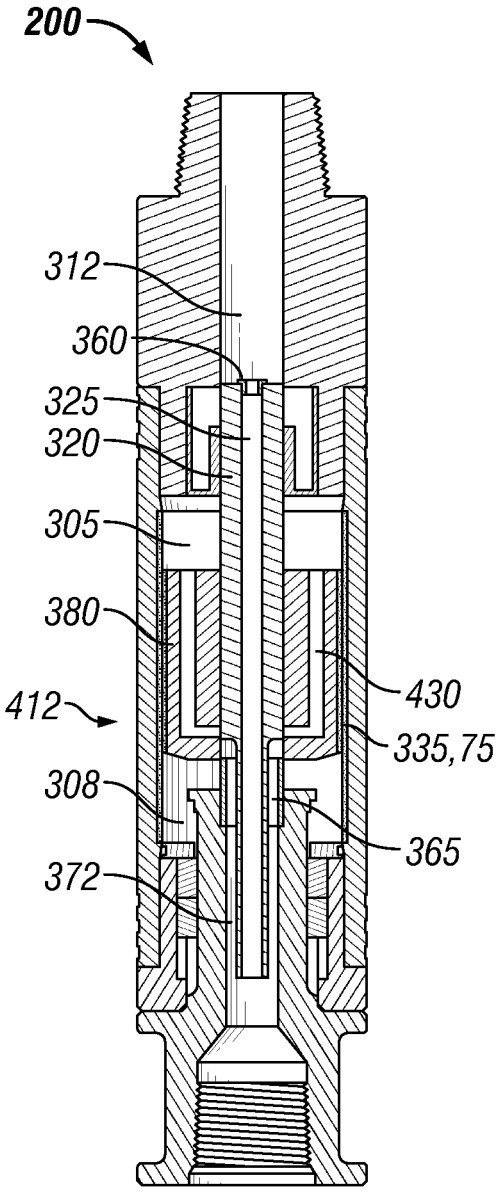

FIG. 4D-1 is a cross-sectional view of the percussion tool 200 with the piston 380 in a second intermediate upward moving position 412 and showing the positioning of the at least one first pressurized fluid conduit 386 and the at least one second pressurized fluid conduit 387 in accordance with an exemplary embodiment of the present invention. FIG. 4D-2 is a cross-sectional view of the percussion tool 200 with the piston 380 in the second intermediate upward moving position 412 and showing the positioning of the at least one top exhaust conduit 430 in accordance with an exemplary embodiment of the present invention. Referring to FIGS. 4D-1 and 4D-2, the piston 380 is positioned in the second intermediate upward moving position 412 and facilitates forming the top pressure fluid chamber 305 above it and the bottom pressure fluid chamber 308 below it. The bottom pressure fluid chamber 308 has further increased in volume and the top pressure fluid chamber 305 has further decreased in volume when compared to when the piston 380 was in the first intermediate upward moving position 411 (FIG. 4C-1). At this second intermediate upward moving position 412, the second pressurized fluid conduits 387 within the piston 380 are no longer in fluid communication with the first openings 327 of the feed tube 320 and hence do not communicate pressurized fluid from the outer feed tube channel 326 to the bottom pressure fluid chamber 308. Similarly, at this second intermediate upward moving position 412, the first pressurized fluid conduits 386 within the piston 380 also are not in fluid communication with any of the second openings 328 of the feed tube 320 and hence are not able to communicate pressurized fluid from the outer feed tube channel 326 to the top pressure fluid chamber 305. Thus, neither the bottom pressure fluid chamber 308 nor the top pressure fluid chamber 305 is filled with pressurized fluid, when the piston 380 is at this second intermediate upward moving position 412. However, the piston 380 continues moving in an upward direction from the forces previously applied to the bottom of the piston. Hence, as the piston 380 continues rising, the volume of the top pressure fluid chamber 305 continues to further decrease, while the volume of the bottom pressure fluid chamber 308 continues to further increase. The pressurized fluid within the bottom pressure fluid chamber 308 still does not exhaust through the exhauster 365 when the piston 380 is at this second intermediate upward moving position 412. Similarly, the fluid within the top pressure fluid chamber 305 no longer continues to exhaust through the exhauster 365 since the top exhaust conduits 430 are not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the bottom pressure fluid chamber 308 or the top pressure fluid chamber 305, and therefore is not used to counteract, or work against, itself when being used to move the piston 380.

Figures 1, 4E:
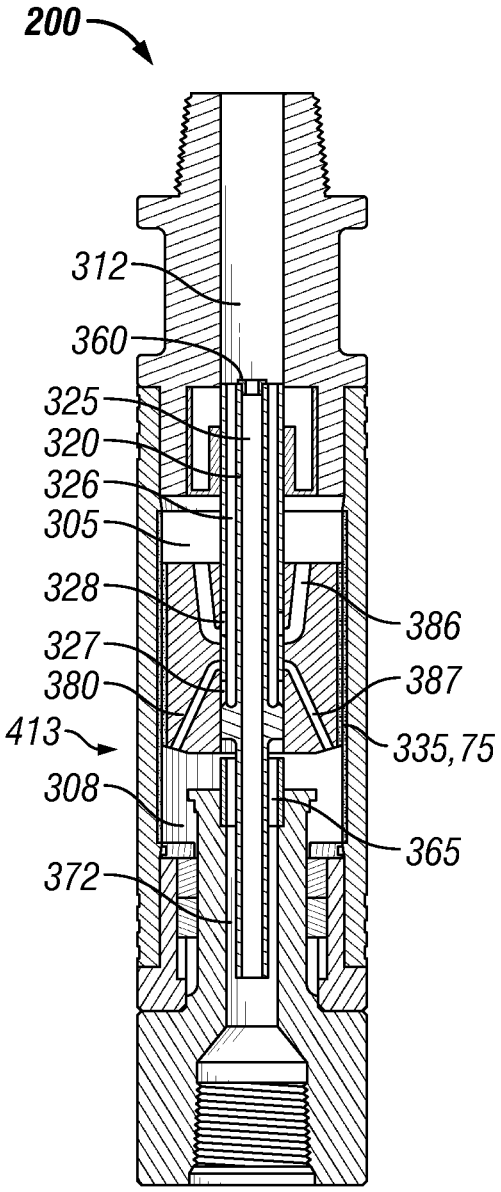
Figures 2, 4E:
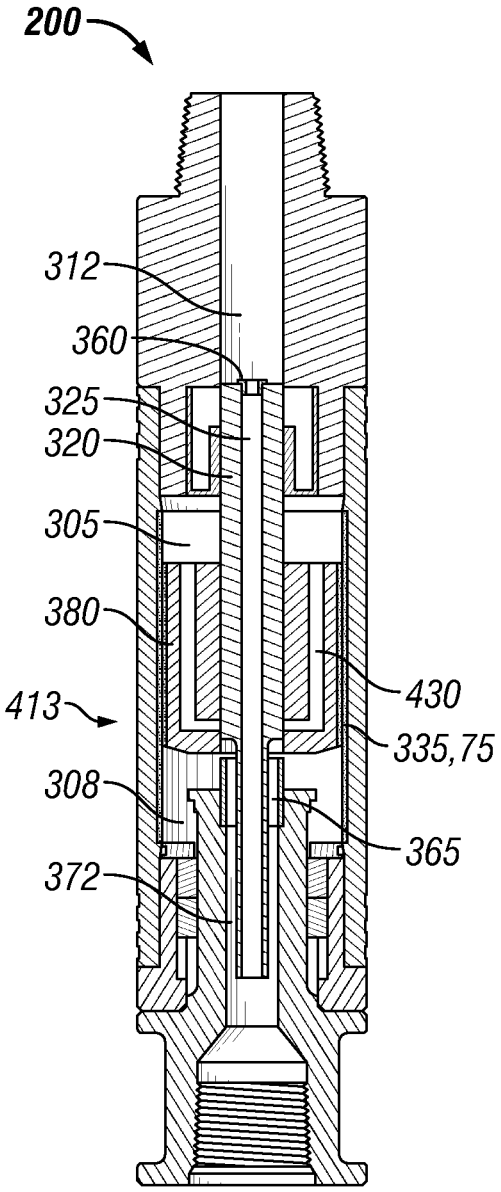

FIG. 4E-1 is a cross-sectional view of the percussion tool 200 with the piston 380 in a third intermediate upward moving position 413 and showing the positioning of the at least one first pressurized fluid conduit 386 and the at least one second pressurized fluid conduit 387 in accordance with an exemplary embodiment of the present invention. FIG. 4E-2 is a cross-sectional view of the percussion tool 200 with the piston 380 in the third intermediate upward moving position 413 and showing the positioning of the at least one top exhaust conduit 430 in accordance with an exemplary embodiment of the present invention. Referring to FIGS. 4E-1 and 4E-2, the piston 380 is positioned in the third intermediate upward moving position 413 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the second intermediate upward moving position 412 (FIG. 4D-1). At this third intermediate upward moving position 413, the first pressurized fluid conduits 386 within the piston 380 are now in fluid communication with at least one respective second opening 328 of the feed tube 320 and hence communicates pressurized fluid from the outer feed tube channel 326 to the top pressure fluid chamber 305. However, at this third intermediate upward moving position 413, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this third intermediate upward moving position 413. As the top pressure fluid chamber 305 is now filled with pressurized fluid and the pressure therein increases, the piston 380 continues rising but starts slowing down, thereby further decreasing the volume of the top pressure fluid chamber 305 and further increasing the volume of the bottom pressure fluid chamber 308. The pressurized fluid within the bottom pressure fluid chamber 308 now exhausts through the exhauster 365 when the piston 380 is at this third intermediate upward moving position 413. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 continues to decrease, the fluid therein is pressurized more since the fluid therein is not exhausted through the exhauster 365. The at least one top exhaust conduit 430 is no longer fluidly communicable with the exhauster 365. This pressurized fluid within the top pressure fluid chamber 305 causes the piston 380 to slow down in its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to slow the movement of the piston 380.

Figures 1, 4F:
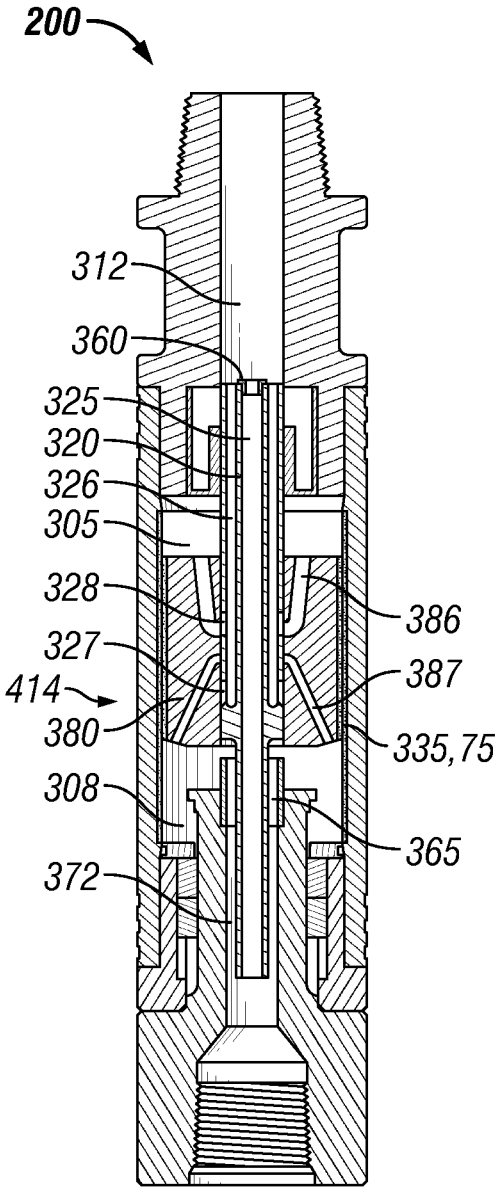
Figures 2, 4F:
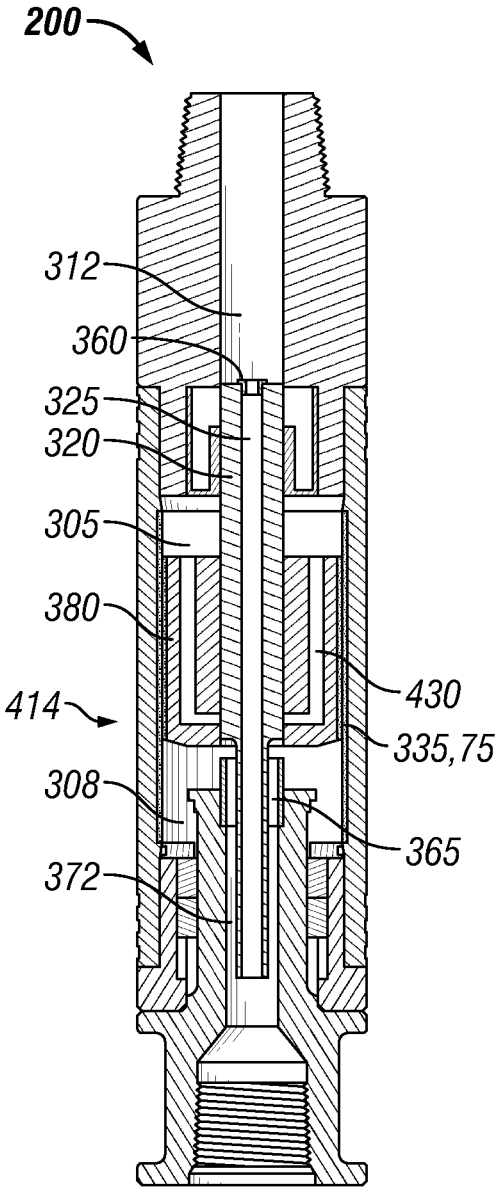

FIG. 4F-1 is a cross-sectional view of the percussion tool 200 with the piston 380 in an up position 414 and showing the positioning of the at least one first pressurized fluid conduit 386 and the at least one second pressurized fluid conduit 387 in accordance with an exemplary embodiment of the present invention. FIG. 4F-2 is a cross-sectional view of the percussion tool 200 with the piston 380 in the up position 414 and showing the positioning of the at least one top exhaust conduit 430 in accordance with an exemplary embodiment of the present invention. Referring to FIGS. 4F-1 and 4F-2, the piston 380 is positioned in the up position 414 and facilitates forming the top pressure fluid chamber 305 above it and the bottom pressure fluid chamber 308 below it. The bottom pressure fluid chamber 308 has increased in volume and the top pressure fluid chamber 305 has decreased in volume when compared to when the piston 380 was in the third intermediate upward moving position 413 (FIG. 4E-1). At this up position 414, the first pressurized fluid conduits 386 within the piston 380 are still in fluid communication with at least one respective second opening 328 of the feed tube 320 and hence communicates pressurized fluid from the outer feed tube channel 326 to the top pressure fluid chamber 305. However, at this up position 414, the second pressurized fluid conduits 387 within the piston 380 are not in fluid communication with any of the first openings 327 of the feed tube 320 and hence are not able to communicate pressurized fluid from the outer feed tube channel 326 to the bottom pressure fluid chamber 308. Thus, now only the top pressure fluid chamber 305 is filled with pressurized fluid while the bottom pressure fluid chamber 308 is not, when the piston 380 is at this up position 414. At this up position 414, the piston 380 is at its highest elevational position and the top pressure fluid chamber 305 is at its smallest volume. As the top pressure fluid chamber 305 continues to be filled with pressurized fluid and the pressure therein increases, the piston 380 will start falling, thereby eventually increasing the volume of the top pressure fluid chamber 305 and decreasing the volume of the bottom pressure fluid chamber 308. The pressurized fluid within the bottom pressure fluid chamber 308 continues to be exhausted through the exhauster 365 when the piston 380 is at this up position 414. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the top pressure fluid chamber 305 is relatively constant, the fluid therein is pressurized more as more pressurized fluid enters the top pressure fluid chamber 305 and since the fluid therein is not exhausted through the exhauster 365. The at least one top exhaust conduit 430 is still not fluidly communicable with the exhauster 365. This pressurized fluid within the top pressure fluid chamber 305 causes the piston 380 to stop its upward movement. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the top pressure fluid chamber 305 and therefore is not used to counteract, or work against, itself when being used to stop the movement of the piston 380.

Figures 1, 4G:
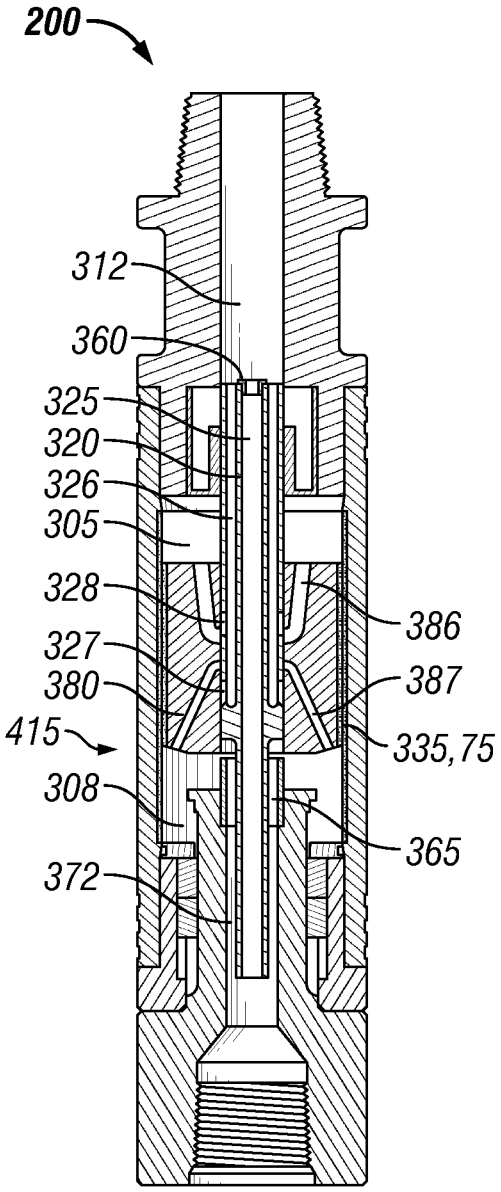
Figures 2, 4G:
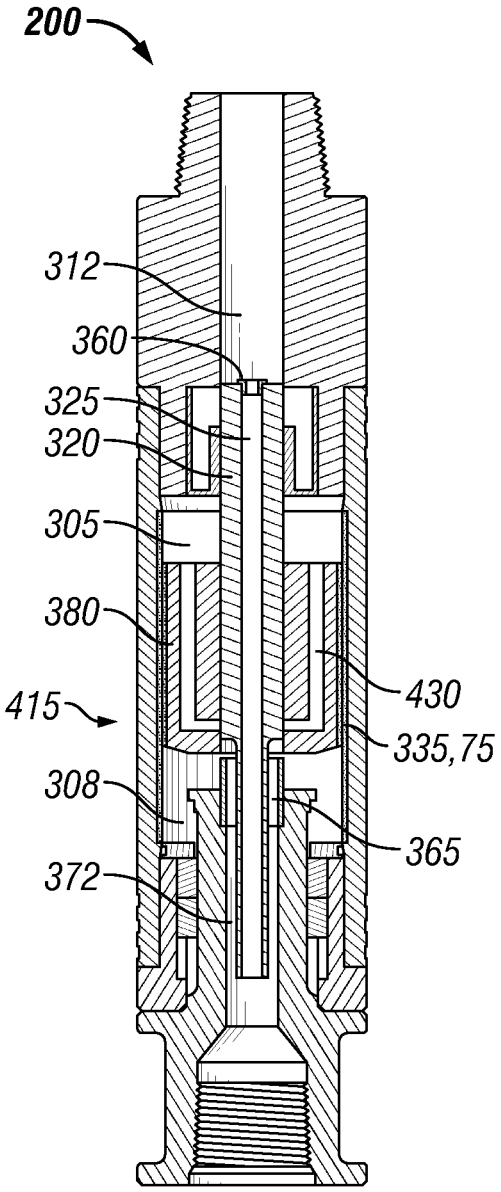

FIG. 4G-1 is a cross-sectional view of the percussion tool 200 with the piston 380 in a first intermediate downward moving position 415 and showing the positioning of the at least one first pressurized fluid conduit 386 and the at least one second pressurized fluid conduit 387 in accordance with an exemplary embodiment of the present invention. FIG. 4G-2 is a cross-sectional view of the percussion tool 200 with the piston 380 in the first intermediate downward moving position 415 and showing the positioning of the at least one top exhaust conduit 430 in accordance with an exemplary embodiment of the present invention. Referring to FIGS. 4G-1 and 4G-2, the piston 380 is positioned in the first intermediate downward moving position 415 and facilitates forming the top pressure fluid chamber 305 above it and the bottom pressure fluid chamber 308 below it. The bottom pressure fluid chamber 308 has decreased in volume and the top pressure fluid chamber 305 has increased in volume when compared to when the piston 380 was in the up position 414 (FIG. 4F-1). At this first intermediate downward moving position 415, the first pressurized fluid conduits 386 within the piston 380 are still in fluid communication with at least one respective second opening 328 of the feed tube 320 and hence continue to communicate pressurized fluid from the outer feed tube channel 326 to the top pressure fluid chamber 305. However, at this first intermediate downward moving position 415, the second pressurized fluid conduits 387 within the piston 380 are still not in fluid communication with any of the first openings 327 of the feed tube 320 and hence still does not communicate pressurized fluid from the outer feed tube channel 326 to the bottom pressure fluid chamber 308. Thus, only the top pressure fluid chamber 305 is filled with pressurized fluid while the bottom pressure fluid chamber 308 is not, when the piston 380 is at this first intermediate downward moving position 415. As the top pressure fluid chamber 305 continues to be filled and the pressure therein increases, the piston 380 continues falling, thereby further decreasing the volume of the bottom pressure fluid chamber 308 and further increasing the volume of the top pressure fluid chamber 305. The pressurized fluid within the top pressure fluid chamber 305 still does not exhaust through the exhauster 365 when the piston 380 is at this first intermediate downward moving position 415. As the volume in the bottom pressure fluid chamber 308 continues to decrease, the fluid therein continues to be exhausted to the outside environment through the exhauster 365 when the piston 380 is at this first intermediate downward moving position 415. This fluid proceeds from the bottom pressure fluid chamber 308, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the pressurized fluid enters the top pressure fluid chamber 305 and the pressurized fluid within the top pressure fluid chamber 305 is not exhausted, the fluid therein forces the piston 380 to move further downward. The at least one top exhaust conduit 430 is still not fluidly communicable with the exhauster 365. The excess pressurized fluid flowing from the sub passage 312, which is not used for filling the top pressure fluid chamber 305, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid still enters only the top pressure fluid chamber 305 and therefore is not used to counteract, or work against, itself when being used to move the piston 380.

Figures 1, 4H:
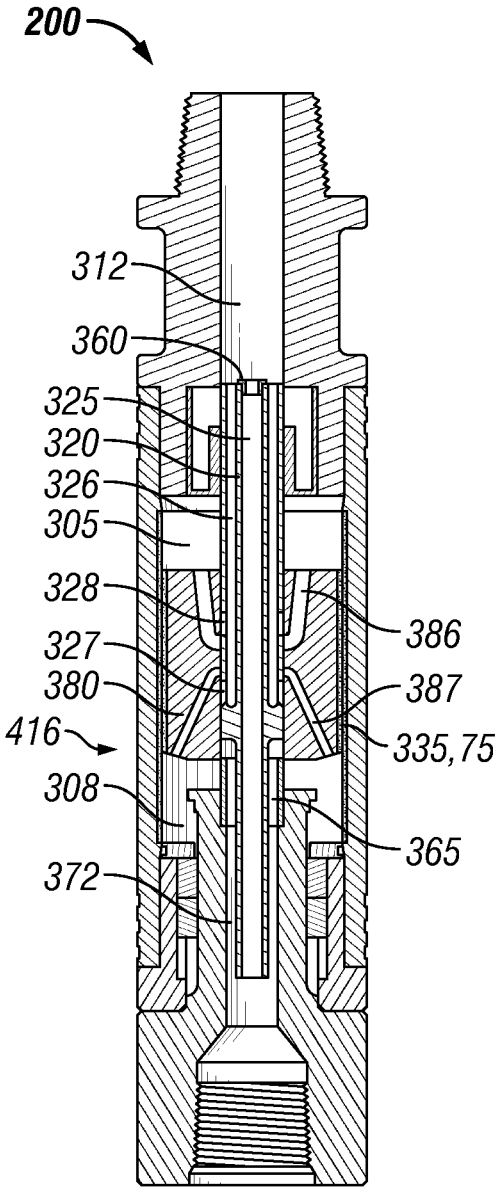
Figures 2, 4H:
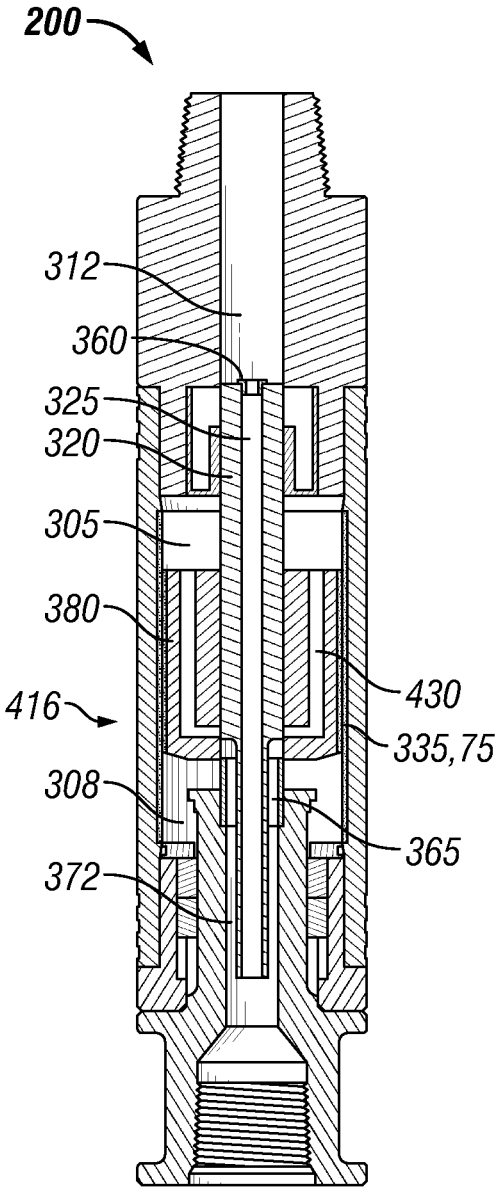

FIG. 4H-1 is a cross-sectional view of the percussion tool 200 with the piston 380 in a second intermediate downward moving position 416 and showing the positioning of the at least one first pressurized fluid conduit 386 and the at least one second pressurized fluid conduit 387 in accordance with an exemplary embodiment of the present invention. FIG. 4H-2 is a cross-sectional view of the percussion tool 200 with the piston 380 in the second intermediate downward moving position 416 and showing the positioning of the at least one top exhaust conduit 430 in accordance with an exemplary embodiment of the present invention. Referring to FIGS. 4H-1 and 4H-2, the piston 380 is positioned in the second intermediate downward moving position 416 and facilitates forming the top pressure fluid chamber 305 above it and the bottom pressure fluid chamber 308 below it. The top pressure fluid chamber 305 has further increased in volume and the bottom pressure fluid chamber 308 has further decreased in volume when compared to when the piston 380 was in the first intermediate downward moving position 415 (FIG. 4G-1). At this second intermediate downward moving position 416, the first pressurized fluid conduits 386 within the piston 380 are no longer in fluid communication with the second openings 328 of the feed tube 320 and hence do not communicate pressurized fluid from the outer feed tube channel 326 to the top pressure fluid chamber 305. Similarly, at this second intermediate downward moving position 416, the second pressurized fluid conduits 387 within the piston 380 also are not in fluid communication with any of the first openings 327 of the feed tube 320 and hence are not able to communicate pressurized fluid from the outer feed tube channel 326 to the bottom pressure fluid chamber 308. Thus, neither the top pressure fluid chamber 305 nor the bottom pressure fluid chamber 308 is filled with pressurized fluid, when the piston 380 is at this second intermediate downward moving position 416. However, the piston 380 continues moving in a downward direction from the forces previously applied to the top of the piston 380. Hence, as the piston 380 continues falling, the volume of the bottom pressure fluid chamber 308 continues to further decrease, while the volume of the top pressure fluid chamber 305 continues to further increase. The pressurized fluid within the top pressure fluid chamber 305 still does not exhaust through the exhauster 365 when the piston 380 is at this second intermediate downward moving position 416 since the top exhaust conduits 430 are not in fluid communication with the exhauster 365. Similarly, the fluid within the bottom pressure fluid chamber 308 no longer continues to exhaust through the exhauster 365 since the bottom pressure fluid chamber 308 is not in fluid communication with the exhauster 365. The excess pressurized fluid flowing from the sub passage 312, which is substantially all the pressurized fluid therein, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid does not enter any of the top pressure fluid chamber 305 or the bottom pressure fluid chamber 308, and therefore is not used to counteract, or work against, itself when being used to move the piston 380.

Figures 1, 4I:
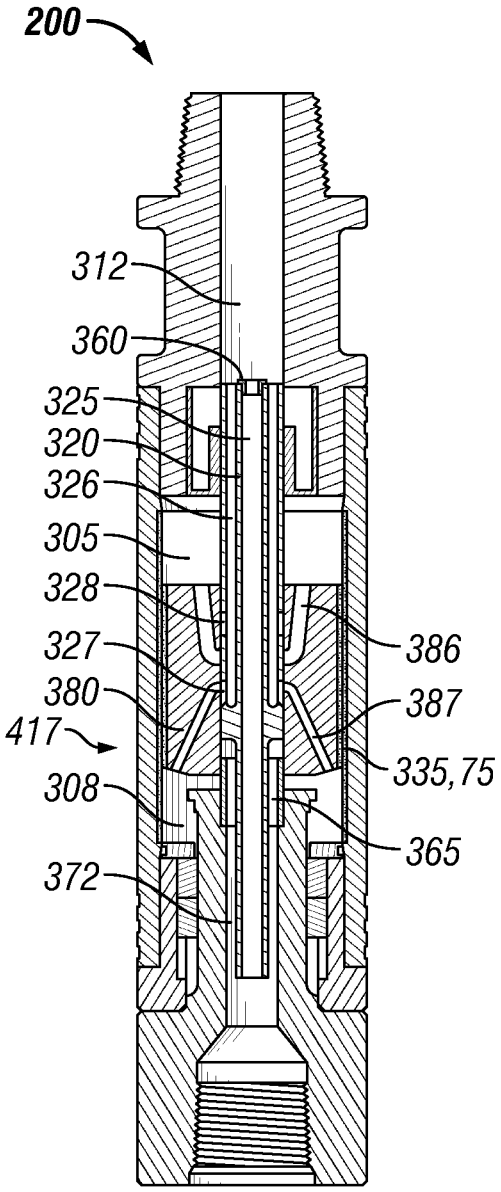
Figures 2, 4I:
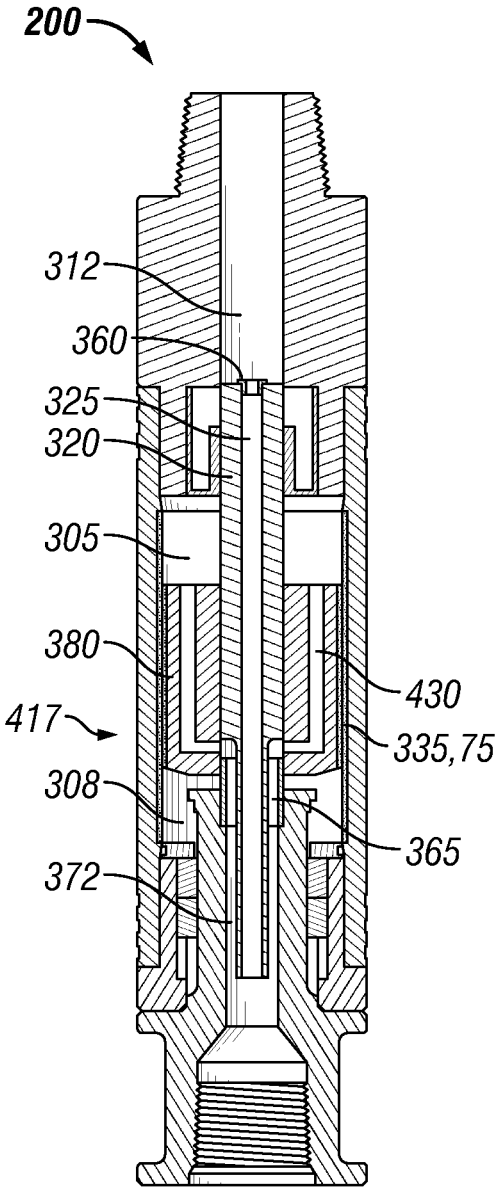

FIG. 4I-1 is a cross-sectional view of the percussion tool 200 with the piston 380 in a third intermediate downward moving position 417 and showing the positioning of the at least one first pressurized fluid conduit 386 and the at least one second pressurized fluid conduit 387 in accordance with an exemplary embodiment of the present invention. FIG. 4I-2 is a cross-sectional view of the percussion tool 200 with the piston 380 in the third intermediate downward moving position 417 and showing the positioning of the at least one top exhaust conduit 430 in accordance with an exemplary embodiment of the present invention. Referring to FIGS. 4I-1 and 4I-2, the piston 380 is positioned in the third intermediate downward moving position 417 and facilitates forming the top pressure fluid chamber 305 above it and the bottom pressure fluid chamber 308 below it. The top pressure fluid chamber 305 has increased in volume and the bottom pressure fluid chamber 308 has decreased in volume when compared to when the piston 380 was in the second intermediate downward moving position 416 (FIG. 4H-1). At this third intermediate downward moving position 417, the second pressurized fluid conduits 387 within the piston 380 are now in fluid communication with at least one respective first opening 327 of the feed tube 320 and hence communicates pressurized fluid from the outer feed tube channel 326 to the bottom pressure fluid chamber 308. However, at this third intermediate downward moving position 417, the first pressurized fluid conduits 386 within the piston 380 are not in fluid communication with any of the second openings 328 of the feed tube 320 and hence are not able to communicate pressurized fluid from the outer feed tube channel 326 to the top pressure fluid chamber 305. Thus, now only the bottom pressure fluid chamber 308 is filled with pressurized fluid while the top pressure fluid chamber 305 is not, when the piston 380 is at this third intermediate downward moving position 417. As the bottom pressure fluid chamber 308 is now filled with pressurized fluid and the pressure therein increases, the piston 380 continues falling but starts slowing down, thereby further decreasing the volume of the bottom pressure fluid chamber 308 and further increasing the volume of the top pressure fluid chamber 305. The pressurized fluid within the top pressure fluid chamber 305 now exhausts through the exhauster 365 when the piston 380 is at this third intermediate downward moving position 417. This fluid proceeds from the top pressure fluid chamber 305, through the at least one top exhaust conduit 430, through the exhauster 365, through the mandrel passageway 372, and out the bit 290 (FIG. 2) through the check valve 302 (FIG. 3), if positioned within the bit 290 (FIG. 2), and the bit passageway 392 (FIG. 3). As the volume in the bottom pressure fluid chamber 308 continues to decrease, the fluid therein is pressurized more since the fluid therein is not exhausted through the exhauster 365. The bottom pressure fluid chamber 308 is no longer fluidly communicable with the exhauster 365. This pressurized fluid within the bottom pressure fluid chamber 308 causes the piston 380 to slow down in its downward movement. The excess pressurized fluid flowing from the sub passage 312, which is not used for filling the bottom pressure fluid chamber 308, flows into the central feed tube channel 325 of the feed tube 320 via the choke 360, then through the exhauster 365 into the mandrel passageway 372, and out the bit 290 (FIG. 2) through the check valve 302 (FIG. 3), if positioned within the bit 290 (FIG. 2), and the bit passageway 392 (FIG. 3). As seen, the pressurized fluid now enters only the bottom pressure fluid chamber 308 and therefore is not used to counteract, or work against, itself when being used to slow the movement of the piston 380.

Figures 1, 4J:
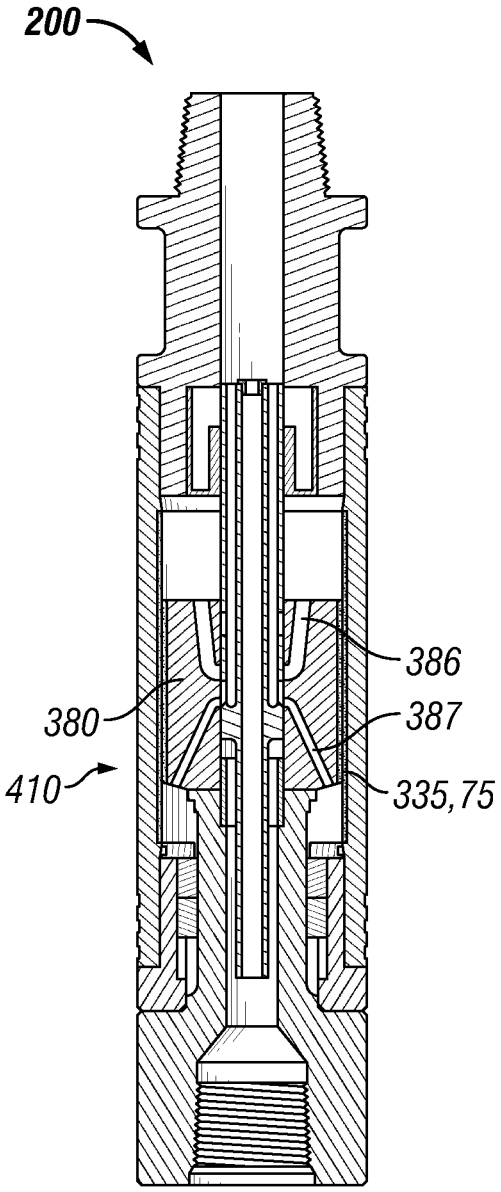
Figures 2, 4J:
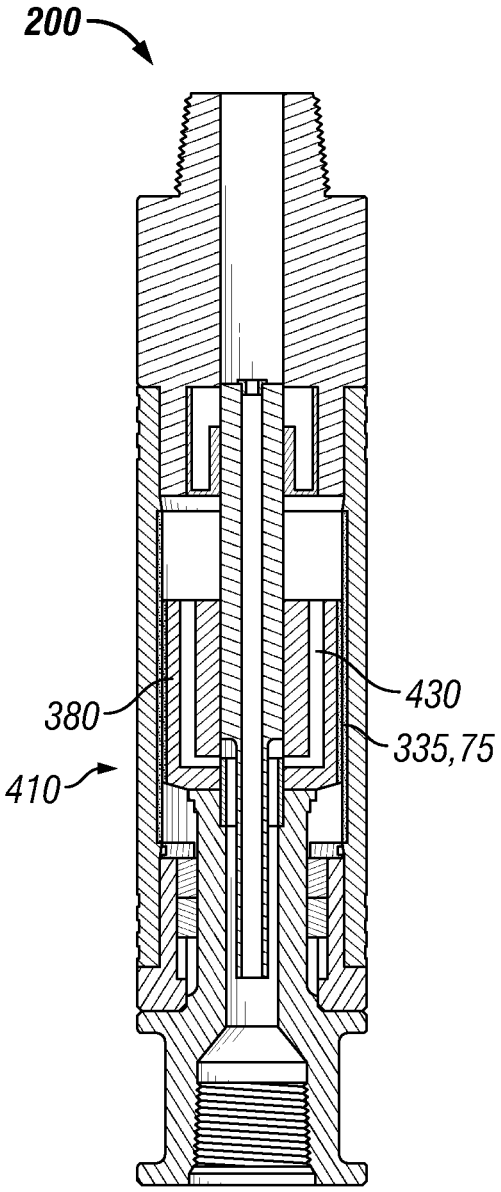

FIG. 4J-1 is a cross-sectional view of the percussion tool 200 with the piston 380 in the down position 410 and showing the positioning of the at least one first pressurized fluid conduit 386 and the at least one second pressurized fluid conduit 387 in accordance with an exemplary embodiment of the present invention. FIG. 4J-2 is a cross-sectional view of the percussion tool 200 with the piston 380 in the down position 410 and showing the positioning of the at least one top exhaust conduit 430 in accordance with an exemplary embodiment of the present invention. FIGS. 4J-1 and 4J-2 illustrate the piston 380 in the same position as illustrated in FIGS. 4B-1 and 4B-2 since the piston 380 has completed one movement cycle. Since FIGS. 4J-1 and 4J-2 illustrate the piston 380 in the same position as illustrated in FIGS. 4B-1 and 4B-2, the description previously provided with respect to FIGS. 4B-1 and 4B-2 also applies to the description of FIGS. 4J-1 and 4J-2; and therefore is not repeated again herein for the sake of brevity.

Although a few exemplary embodiments have been described and/or illustrated with respect to the components used in fabricating the percussion tool 10/200 and with respect to the operation of the percussion tool 10/200, modifications made with respect to these components and/or how the percussion tool 10/200 operates are envisioned to be included within the exemplary embodiments of this invention. For example, as previously mentioned, the check valve 302 may be placed upstream of the choke 360 or downstream of the choke 360, such as within the bit 290. Other types of modifications may be made such as reducing the number of components or increasing the number of components. Further, the connection type between the components may be altered without departing from the scope and spirit of the exemplary embodiments. Further, although the exemplary embodiments has been illustrated using a roller cone bit being coupled to the mandrel 270, other types of bits may be coupled to the mandrel 270, such as fixed cutter bits and hammers. Alternatively, these bits may be integrally formed with the mandrel 270 without departing from the scope and spirit of the exemplary embodiments.

Further, although the ferritic nitrocarburization heat treating is applied to one or more surfaces in the embodiments described above, the ferritic nitrocarburization heat treating may be applied within other percussion tool types, such as those in the prior art. Additionally, although the one or more coatings 335 are applied to one or more surfaces in the embodiments described above, the one or more coatings 335 also may be applied within other percussion tool types or other tool types in which parts are moving with respect to each other.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A downhole percussion tool, comprising:

a casing comprising a top end, a bottom end, and an internal surface extending from the top end to the bottom end, the internal surface defining a casing passageway extending longitudinally therethrough;

a top sub comprising a top end coupleable to a drill string and a bottom end coupled to the top end of the casing;

a mandrel being supported within a lower portion of the casing;

a piston slidably mounted within the casing passageway above the mandrel and moveable to deliver an impact force onto the mandrel, the piston comprising:

an interior wall extending from an upper surface of the piston to a lower surface of the piston and defining a piston passageway extending longitudinally therethrough; and an exterior wall surrounding the interior wall and extending from the upper surface of the piston to the lower surface of the piston, the exterior wall and the casing being positioned in close fitting relationship;

one or more portions of the internal surface of the casing or the exterior wall of the piston has been modified using a ferritic nitrocarburization process;

a rotary bit coupled to the mandrel and extending outwardly from a bottom portion of the mandrel, and wherein:

each of the top sub and the mandrel has a respective passageway extending longitudinally therethrough and in fluid communication with the piston passageway for supplying pressurized fluid from the drill string to the rotary bit, the rotary bit has a bit passageway extending therein and in fluid communication with the mandrel passageway, the piston further comprises:

an inlet port formed in the exterior wall of the piston and an inlet passage extending from the inlet port to the lower surface of the piston, and an exhaust passage extending from the piston passageway to the exterior wall of the piston, the downhole percussion tool further comprises a tube extending from an upper portion of the mandrel, a base portion of the piston passageway is enlarged to receive the tube when the piston is engaged with the mandrel, the exhaust passage extends from the base portion of the piston passageway, and one or more portions of the internal wall of the piston or the exterior wall of the tube has been modified using a ferritic nitrocarburization process.

2. The downhole percussion tool of claim 1, wherein the rotary bit is a roller cone bit.

3. The downhole percussion tool of claim 1, wherein the modified portions include the exterior wall of the piston.

4. The downhole percussion tool of claim 1, wherein the modified portions include the internal surface of the casing.

5. The downhole percussion tool of claim 1, wherein:

each of the piston and the casing is made of steel, and a coating is bonded to the modified portions and has one or more layers.

6. The downhole percussion tool of claim 5, wherein one of the layers of the coating is made from a material softer than the respective steel.

7. The downhole percussion tool of claim 5, wherein one of the layers of the coating is made from a material harder than the respective steel.

8. The downhole percussion tool of claim 1, further comprising a drive sub coupling the mandrel to the casing while allowing limited longitudinal movement therebetween.

9. The downhole percussion tool of claim 1, wherein:

the downhole percussion tool further comprises a sleeve positioned within the casing and about the exterior wall of a portion of the piston, and the sleeve has been modified using a ferritic nitrocarburization process.

10. The downhole percussion tool of claim 1, further comprising a check valve disposed in one of the passageways, wherein the check valve allows flow of the pressurized fluid form the drill string to the rotary bit and prevents reverse flow from the rotary bit to the drill string.

11. The downhole percussion tool of claim 1, further comprising a choke positioned within the piston passageway adjacent to the upper surface thereof.

* * * * *